United States Patent [19]

Perrault

[11] 4,405,225

[45] Sep. 20, 1983

[54] COLLATOR

[75] Inventor: Eric P. Perrault, Seattle, Wash.

[73] Assignee: Donald L. Snellman, Seattle, Wash.

[21] Appl. No.: 219,527

[22] Filed: Dec. 23, 1980

[51] Int. Cl.[3] ..... G03G 15/00; G03G 21/00

[52] U.S. Cl. ..... 355/14 R; 271/288; 271/296; 355/3 SH; 355/14 SH

[58] Field of Search ..... 355/3 R, 3 SH, 14 R, 355/14 SH; 271/288, 289, 290, 296

[56] References Cited

U.S. PATENT DOCUMENTS

| | | | |
|---|---|---|---|
| 3,460,824 | 8/1969 | Bahr et al. | 271/290 |
| 3,561,753 | 2/1971 | Snellman | 271/290 |
| 3,774,906 | 11/1973 | Fagan et al. | 271/289 |
| 3,871,643 | 3/1975 | Kukucka et al. | 271/290 |
| 3,905,594 | 9/1975 | Davis | 271/290 |
| 4,012,034 | 3/1977 | Nelson | 271/290 |
| 4,068,837 | 1/1978 | Lamos | 271/296 |
| 4,114,871 | 9/1978 | Botte | 271/296 X |
| 4,273,326 | 6/1981 | Snellman et al. | 271/296 X |
| 4,285,508 | 8/1981 | Kaneko | 271/296 X |
| 4,341,462 | 7/1982 | Ogura | 355/3 SH X |

*Primary Examiner*—Fred L. Braun

*Attorney, Agent, or Firm*—Seed, Berry, Vernon & Baynham

[57] ABSTRACT

A sophisticated collator having a general purpose microprocessor with a stored program is capable of intercommunicating with a sophisticated photocopier. In most operations, the collator functions as a slave to the photocopier. It processes a collator task by receiving and processing signals from several sensors positioned about the collator. A manual insertion assembly allows entry of sheets into the collator from a source other than the photocopier. Proofed pages can be re-fed for collating, or jobs from a second source may be processed. Thus the collator need not be a slave only to the photocopier. A second vacuum belt reduces problems of transporting wide paper. Diverting fingers may contact the conveyor system to allow sheets to pass over a bin into additional bin units attached to the sophisticated collator.

8 Claims, 9 Drawing Figures

FIG. 1
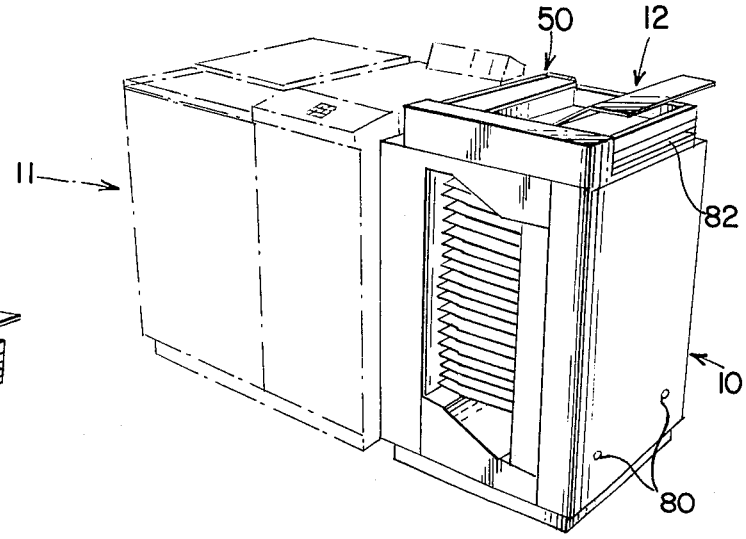
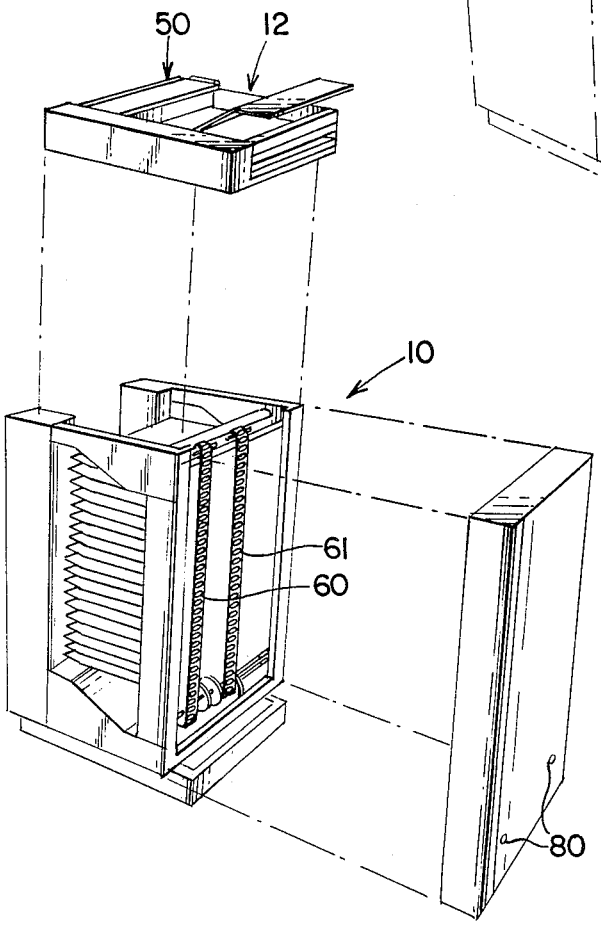
FIG. 2
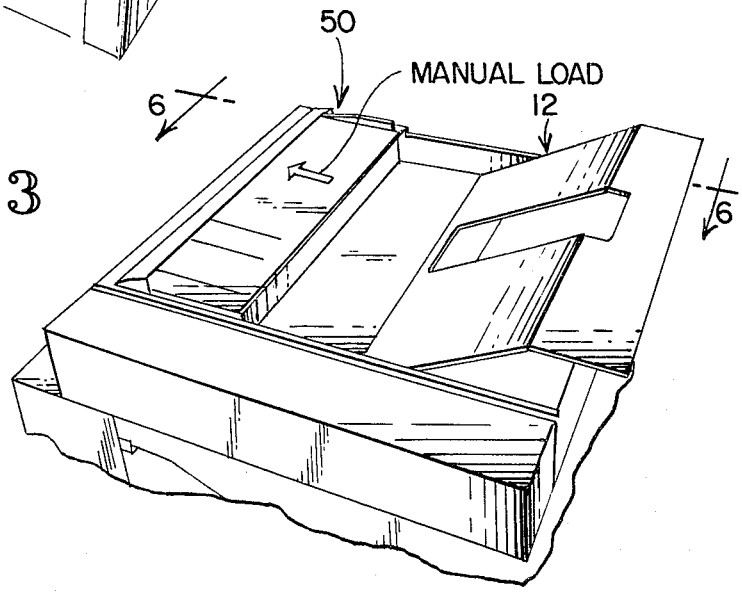
FIG. 3

COLLATOR

DESCRIPTION

TECHNICAL FIELD

This invention relates to a sophisticated collator capable of intercommunication with a computer-controlled photocopier. The collator has a logic control means having a stored program which responds to job commands of the photocopier. Information from various sensors aids collating of sheets from the photocopier.

BACKGROUND ART

Collator technology has improved steadily. Demand has arisen for fast collating with expanded capabilities. With this demand has also come correlative problems in the collator mechanics. The art of microprocessor control has allowed many of these problems to be reduced or eliminated. This invention relates to use of a sophisticated logic control means which will allow the collator to perform tasks more quickly with fewer problems. The collator functions as a slave to a sophisticated, computer-controlled photocopier. Through a computer link, the two devices can operate together to better achieve desired results.

There are far too many collator patents to describe them all in this introductory section. However, a few should be mentioned. U.S. Pat. No. 3,905,594 (Davis) discloses a randomly programmed, sequential sheetsorting machine for filling trays with differing numbers of sheets. A computer memory stores input on the number of sheets desired in a particular tray. When operating, the collator counts the sheets for each tray. Each job must be individually programmed. Because most collating jobs require sorting a consistent number of sheets to each tray, the program capability, which is the essence of the Davis invention, has limited use.

U.S. Pat. No. 3,772,970 (Snellman et al.) discloses another collator which may be programmed to distribute selected numbers of sheets to selected sheet receivers. This collator uses relays and contacts to perform its desired sorting. This electromechanical control system requires manual programming before each sorting job.

Yet another collator for placing an unequal number of sheets into separate trays is disclosed in U.S. Pat. No. 3,572,685 (Snellman). A dispatcher assembly controls the operation of a distributor in accordance with sequentially recorded information advanced through an information-sensing or "readout" section of the assembly. Magnetic tape at each tray is read to determine how many sheets should be placed in that tray. Alternatively, a punch card reader may be used. A memory stores the information on sheets and trays and controls the sheet deflector assembly.

U.S. Pat. No. 3,618,936 (Ziehm) discloses an improved jam detection system for sorting apparatus. The system comprises program means to actuate individual deflector members to route documents into a selected tray in a predetermined sequence, sensing means disposed along the feed path for the document, and a timing circuit with an output to control the feed path.

U.S. Pat. No. 3,709,485 (Acquaviva, Jr.) discloses a control circuit for a sorting system. A jam detection circuit times signals received. The circuit is coupled to the motor drive of the conveyor. When sheets jam, the conveyor will be shut down. Relays and phototransistors along the conveyor collect information. Comparison circuits count the numbers of sheets reaching trays.

Although some of these patents disclose limited aspects of microprocessor control, none discloses the intercommunication and cooperation with a sophisticated, computer-controlled photocopier. Much of the utility of this invention relates to its flexibility in responding to tasks ordered by the photocopier. Its ability to store functions for later use, to detect errors, and to converse with its overlord photocopier makes this invention a valuable and much desired improvement over other machines.

DISCLOSURE OF THE INVENTION

A novel feature of this invention relates to a sophisticated collator's ability to intercommunicate with and to respond to a computer-controlled photocopier. A logic control means on the collator of this invention has a programmable computer with a stored program. Unlike electromechanical relays or random logic control, this computer is readily adaptable through reprogramming. Its function is not necessarily fixed, although during any particular collator operation, its function is predetermined. The logic control means converses with the photocopier to receive job commands and information on the running of a particular job in the photocopier. It acts upon these job commands to sort sheets, principally in three modes: proof, stack or collate. To aid its completion of a job, the logic control means receives and processes signals from several sensors around the collator. Thus the job is completed more efficiently, or notification as to a particular problem is more detailed.

Another novel feature of this invention relates to a manual insertion means which interconnects with the customary sheet conveyor system of the collator. While attached to a photocopier, this means allows entry of sheets from a second source. The manual insertion means allows dual functioning for the collator. The preferred collator need not only function as a slave to the sophisticated photocopier, but it can collate other jobs through this secondary input. The manual insertion means is particularly useful for refeeding sheets displaced in a collator jam or for running small collating jobs in which prior photocopying is unnecessary.

BRIEF DESCRIPTION OF THE DRAWINGS

FIG. 1 is a perspective view of the collator of this invention connected to a photocopier.

FIG. 2 shows an assembly drawing of the collator of FIG. 1, illustrating access means to the mechanical works.

FIG. 3 is an isometric view illustrating the preferred manual insertion means and proof tray of this invention.

BEST MODE FOR CARRYING OUT THE INVENTION

Figure 5:
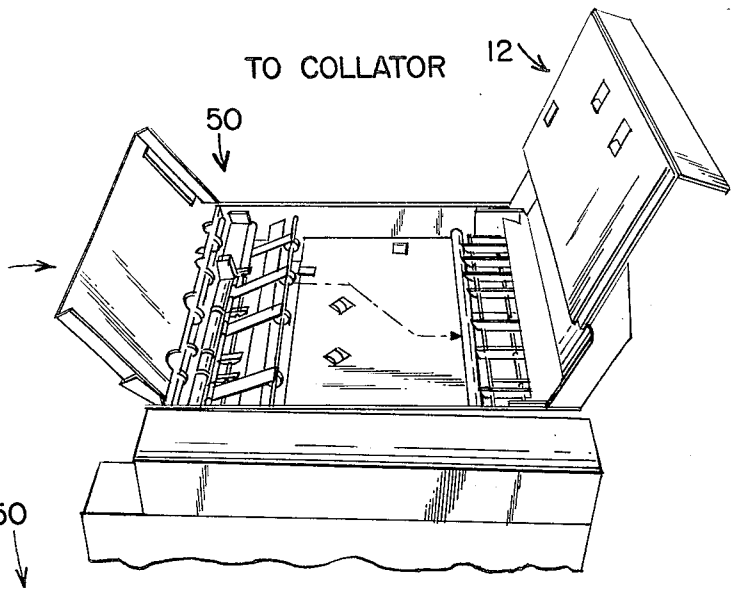
FIG. 5 is an isometric view illustrating the sheet conveyor system over the top of the collator.
Figure 4:
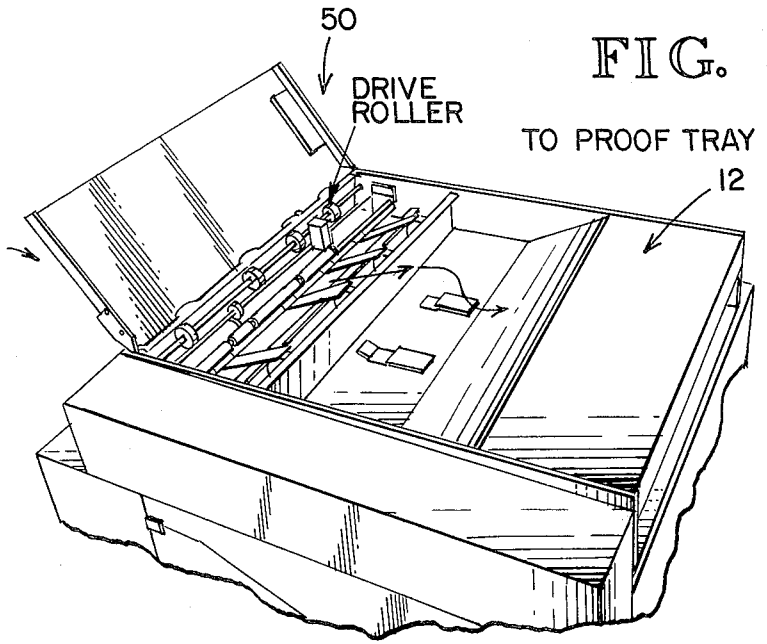
FIG. 4 is an isometric view illustrating the entry for sheets into the proof tray.
Figure 6:
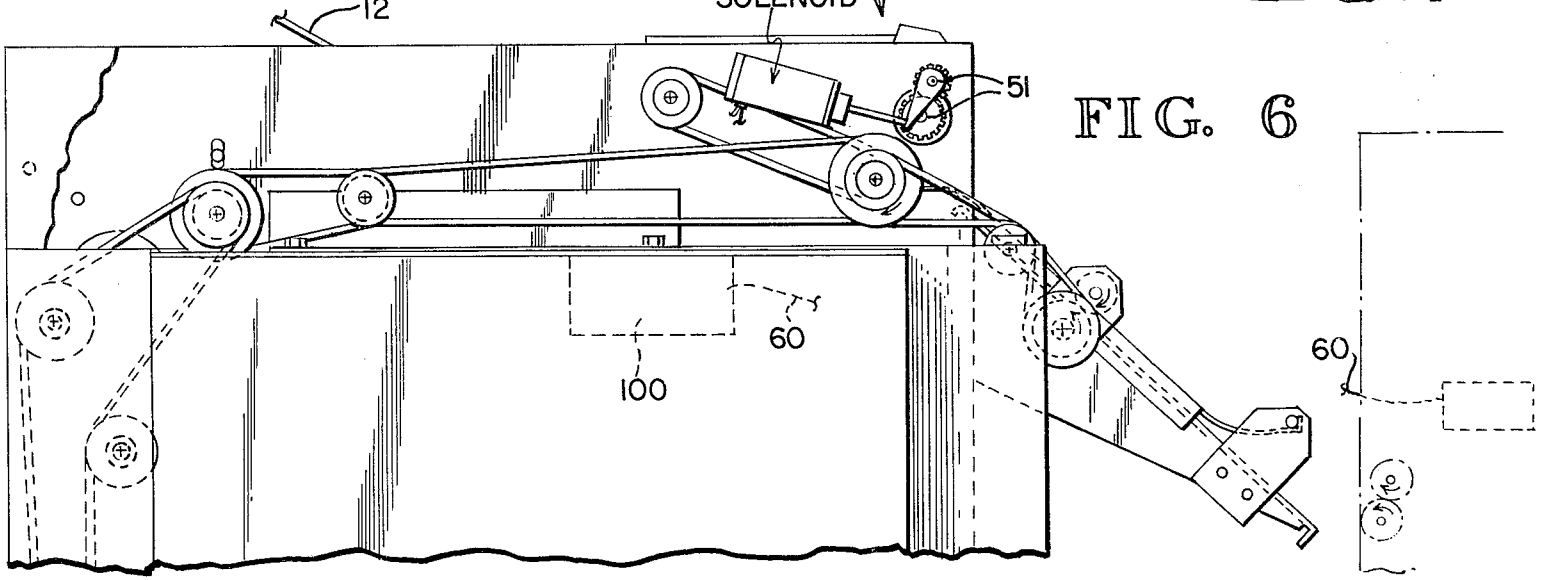
FIG. 6, a section along line 6—6 of FIG. 3, shows the preferred drive means for the conveyor system.
Figure 7:
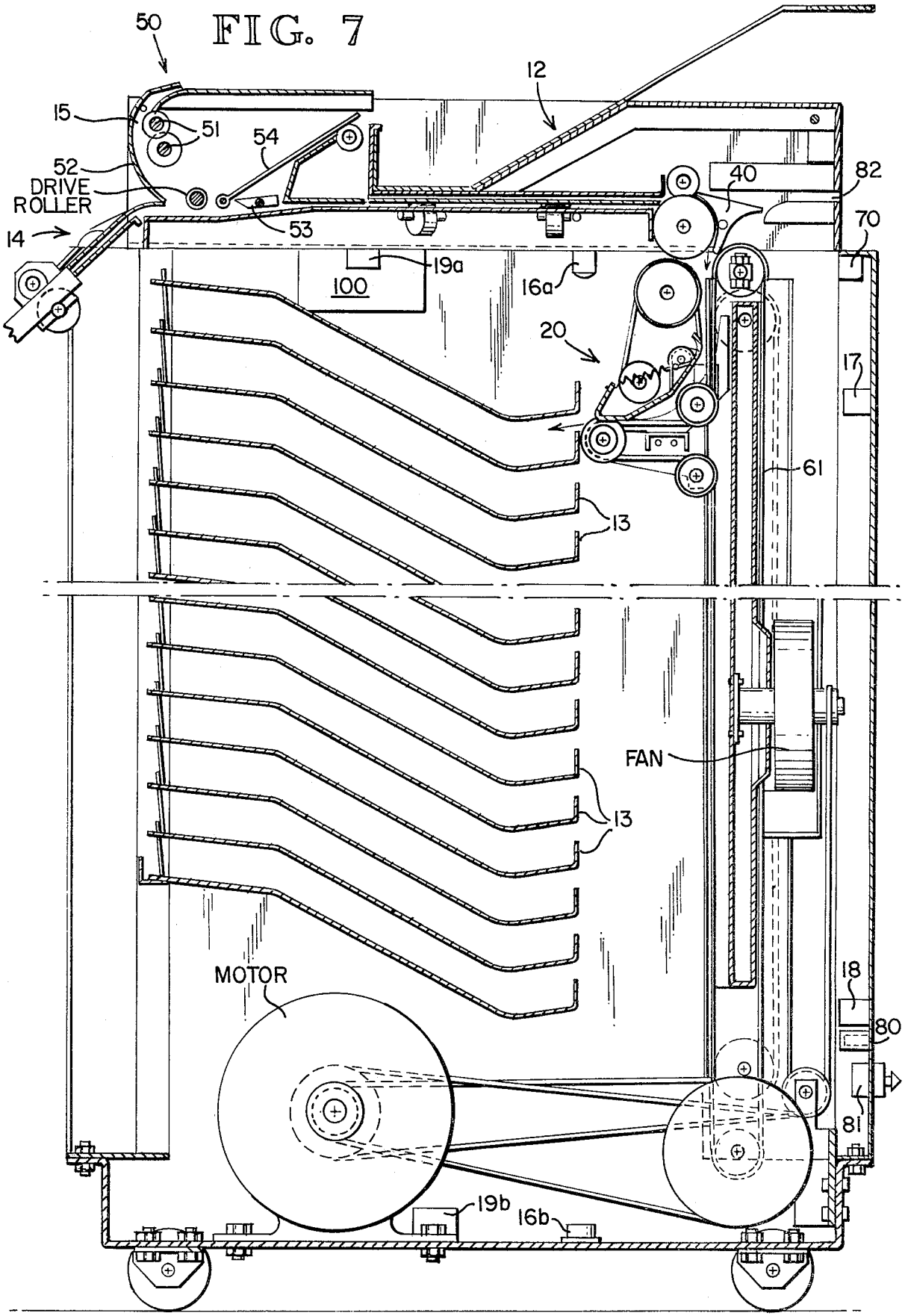
FIG. 7, a section along line 7—7 of FIG. 8, shows details of the conveyor system and deflector assembly of the collator.

The collator 10 of this invention responds to commands of a sophisticated photocopier 11 to process sheets. To receive information and to process it so that the job commands may be executed, this sophisticated collator features a logic control means 100 (see FIGS. 6 and 7) having a digital computer with a stored program. Zilog Z80 chips have proven satisfactory for this application. Upon command from the photocopier 11, which also has a computer to aid its operation, the collator of this invention operates quickly and efficiently to sort incoming sheets. It records and processes the order, knowing the number of sheets in the job and their desired disposition to the trays. Using sensed information from several sensors mounted along the path of the conveyor system of the collator, the collator processes the sheets in three modes: to proof, to stack, or to collate. In proof mode, the sheets which enter from the photocopier are routed to an accessible bin 12 on the top of the collator. Dog 53 (see FIG. 7) lowers plate 54 to contact the common conveyor system and to deflect incoming sheets into the proof tray. In stack mode, sheets are routed to the first open tray 13 in a bin and subsequent sheets continue to this tray until it is filled. Then the deflector assembly moves to the next tray, which is filled by subsequent sheets. In collate mode, the sheets proceed to a series of trays, the collator accomplishing the sorting of the various sheets.

Means for communicating 60 (see FIG. 6) with the photocopier, such as direct wiring, interconnect the photocopier and collator so that information may be interchanged between the two logic control means. Initially, the photocopier 11 signals the mode of operation and the size of the job. The collator's logic control means 100 surveys its sensors to prepare for processing. If a problem is detected, it will communicate that fact back to the photocopier. If no problems exist, the collator 10 will prepare to receive sheets. For each sheet passing out of the photocopier, the collator will receive a counting signal. Similarly, a sensor 14 (see FIG. 7) at the entrance to the collator signals the successful arrival of each sheet. The passage of paper over the entrance sensor is timed so that the collator may calculate the anticipated arrival at the desired bin and tray. Either adaptive timing for each sheet or a threshold time failure system may be used to detect jams along the path. As the paper leaves the entrance sensor 14, a clock times its travel to the tray against the prescribed time for travel. If the paper fails to reach the tray entrance sensor **16*a* and 16*b* within the prescribed time, notice of a jam is sent to the photocopier. The entrance sensor 14 preferably is a microswitch which is tripped by the paper as it moves along the conveyor. If a jam is detected, the logic control means reduces the power in the collator, signals the jam, and stores the progress of the job. When the jam is successfully overcome, the collator returns to the job command. A jam reset sensor 70** manually signals that jams have been cleared.

A second type of jam detection is accomplished at each sensor. When the leading edge of a sheet contacts the sensor, a clock begins to time the passage of paper over the sensor. The clock resets when the trailing edge of a sheet leaves the sensor. If the time of travel exceeds a threshold value (at which point the clock expires), a jam will be signalled for that sensor.

A preferred timer capitalizes on the time-sharing capacity of the computer. The job functions are interrupted and stored in a sequence at predetermined intervals. A specific address in the random access memory (RAM) easily serves as a clock for jam detection purposes. The threshold time is determined as a multiple of the time-sharing interrupts. The RAM address is incremented from its elapsed count to the added threshold count. The RAM address and the actual interrupt count are compared for each sheet. If the actual count exceeds the RAM increment, a jam has occurred.

The tray entrance sensor is preferably a photocell **16*a* and light source 16*b*** which is intermittently cut when sheets are deflected into the trays. Each break in the signal serves as a paper count. The signal also resets the clock circuits for retiming.

Figure 8:
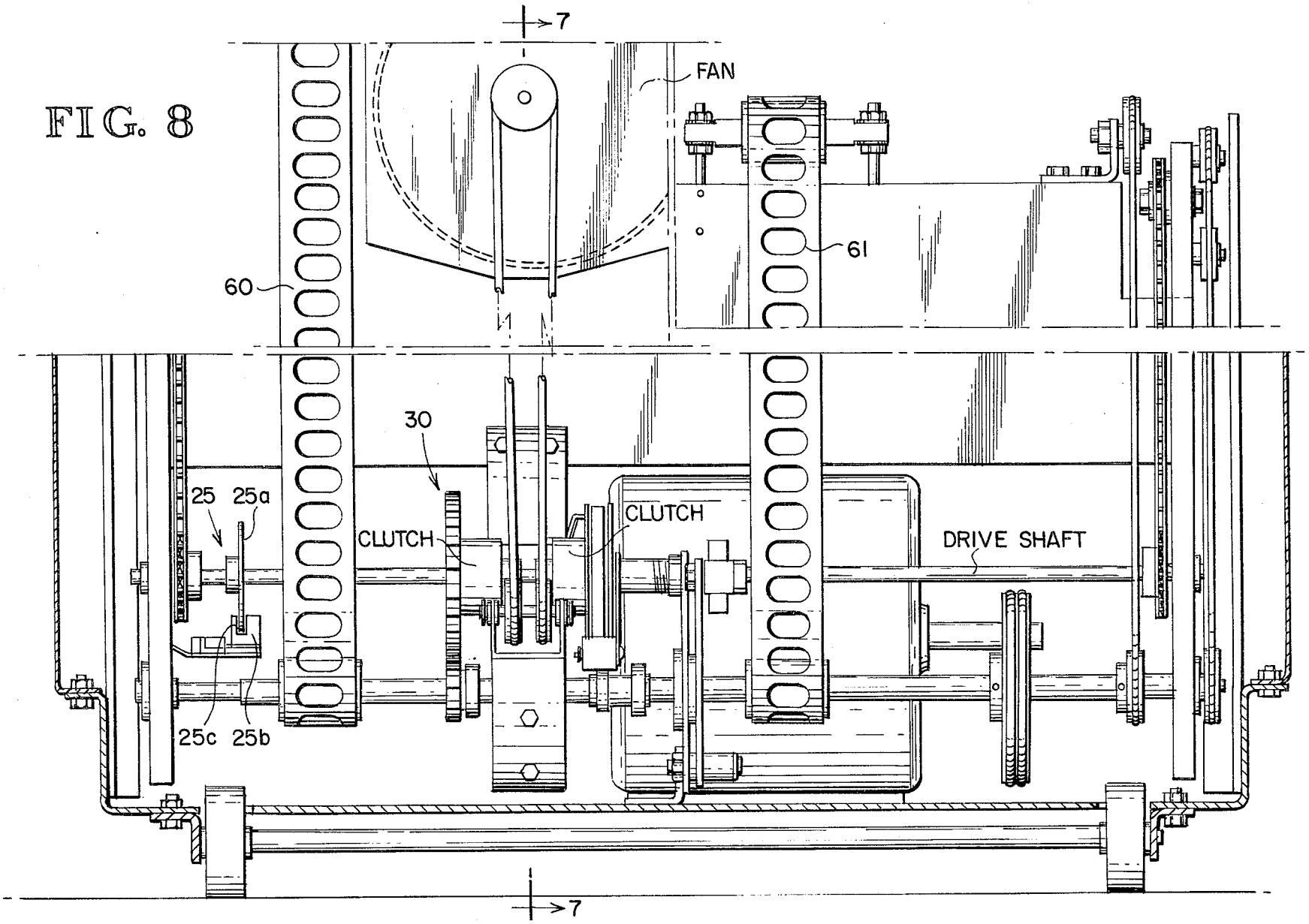
FIG. 8 shows a detail of the drive means for the collator, illustrating the means for identifying the individual trays of a bin.

Three sensors help to control the position of the deflector assembly 20. A home sensor 17 (see FIG. 7) indicates that the deflector is at the first tray 13 of a bin. Similarly, an end sensor 18 signals that all trays in a bin have been filled. Both of these sensors are preferably Hall effect sensors. The third sensor 25 (see FIG. 8) counts the position of the deflector assembly between home and end. Two halves of a Hall effect sensor **25*b* and 25*c* are arranged so that a means for interrupting 25*a* can break the sensor's magnetic field each time the deflector assembly 20 moves one tray. A star wheel positioned to cut across the field with alternate openings and fans functions smoothly as the means for interrupting 25*a*. This star wheel is easily fitted to the drive means 30 for the deflector assembly 20. Each time the deflector assembly 20 moves one tray 13, the wheel 25*a* spins to cut and then to restore the field, allowing the logic control means 100** to record the position of the deflector assembly. A photocell/light source combination might also be used.

To detect if there is any paper in any tray of a bin unit (i.e., if the bin unit is free of paper in any tray), a photocell **19*a* and light source 19*b* (see FIG. 7) are positioned at the top and bottom of the bin unit. Paper in a tray breaks the beam. The logic control means 100** interprets this information.

To allow other bin units to be added, the collator may be designed with interconnecting means 80. Keyways 80 on one bin unit receive matching keys on a second bin unit. Sheets pass through a slot 82 in the side of the bin. Sensors 81 detect connection of additional bin units and signal to the logic control means. With the information of the number of bin units, the logic control means can determine if the size of job requested is proper. Also, when a deflector assembly 20 reaches the last tray of a bin unit, the logic control means 100 may signal diverter fingers 40 to allow sheets to pass over the filled bin. These fingers flip to contact the conveyor system of the bin to make a route to the next bin.

Another novel feature of this invention is a manual insertion means 50 on the collator to allow entry of sheets from a source other than the photocopier. The preferred means includes a microswitch sensor 15 to detect entry of sheets. The logic control means then powers drive wheels 51 which convey sheets to the usual conveyor system for the collator. The manual insertion means 50 is particularly useful to refeed sheets which are diverted to the proof tray 12 when a jam between the proof tray 12 and the trays 13 of a bin is detected. Also, this feature allows the collator 10 to process jobs from a source other than the photocopier 11. Not only is the collator a slave to the sophisticated, computer-controlled photocopier with which it is designed to intercommunicate, but it can act independently to process other jobs. Most of these other jobs will be small, so manual insertion through a curving reception passage 52 at the top of the collator is ordinarily adequate. More sophisticated entry means could easily be designed into the structure, however.

To control wider sheets of paper with less problem, this collator also includes a second vacuum belt 61. With suction at two points, the wider sheets adhere better to the conveyor system. Edges do not curl as frequently. Jams are reduced. The second belt 61 is offset from the common belt 60. It need not be used if the paper does not call for the added suction.

A Preferred Control Program

Figure 9:
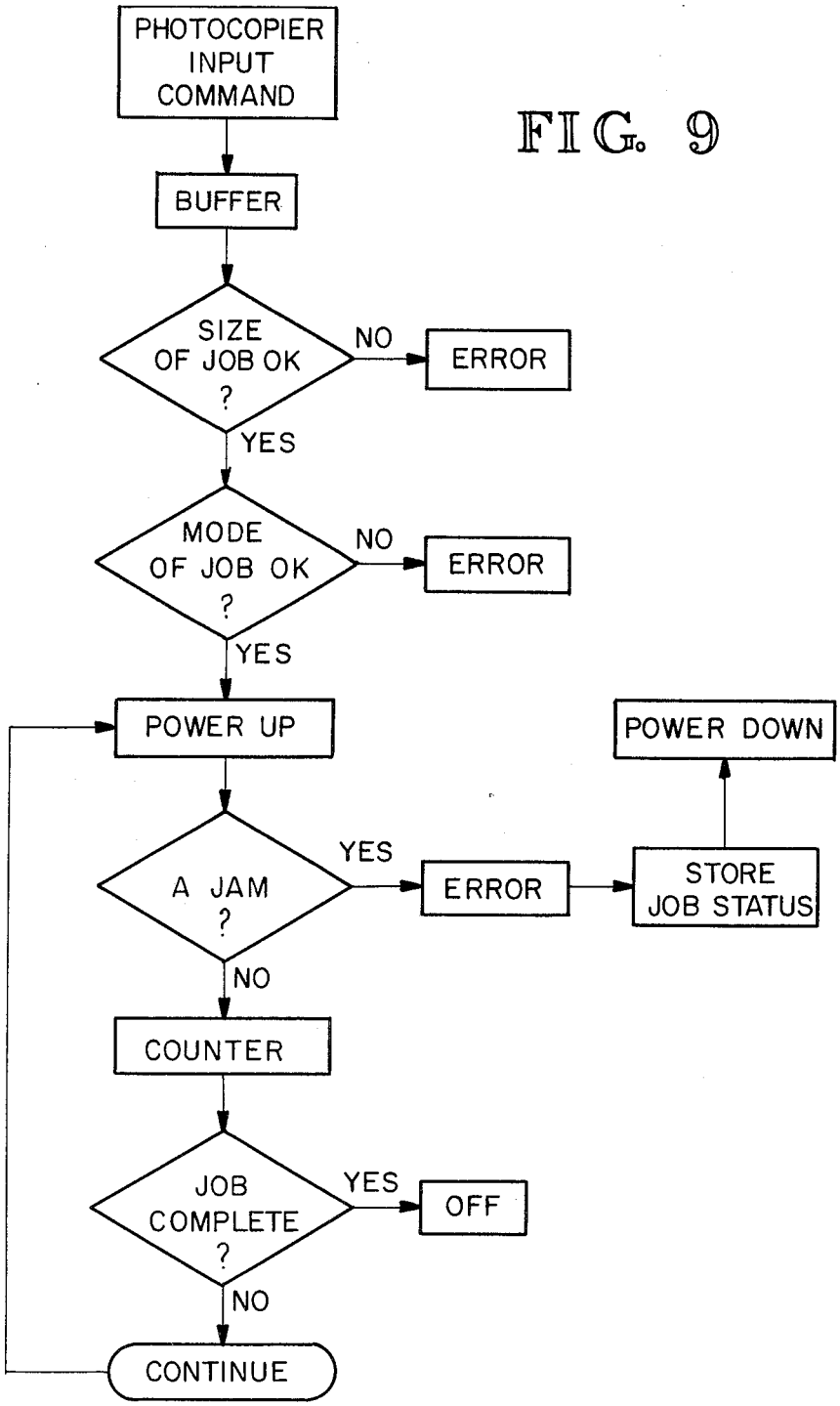
FIG. 9 is a simplified flow chart of the control system.

As best understood with reference to FIG. 9, the logic control means of this collator is programmed to receive input commands from a photocopier. As a first step, the collator records these commands in a buffer. If the copier is then altered, the job status will be preserved. Reading from the buffer, the collator scans its several sensors to see if the desired task is performable. It checks the size and type of job, looking for problems in the sheet path. If the task is performable, the logic control means powers up the various mechanical means required to perform the task. The deflector assembly is brought home, the vacuum is started, the conveyor motors and associated parts are ready. When sheets are received, the logic control means processes them, checking for jamming. It counts the sheets so that it may know where it is in the desired job. If a jam occurs, it will store its status so that upon resetting, it may proceed from the point at which the jam occurred. Each sensor supplies information on this job status. Running jobs may be interrupted to interject special jobs, and yet the collator can return to the point at which it was interrupted without reentry of the job commands. Sheets in the trays need not be removed when a running job is interrupted, but a signal may be given that all trays have some sheets in them, if it is so desired. When the job is completed and the buffer is cleared, the collator will automatically power down.

A preferred program using Z80 assembler language to accomplish the multiple functions generally described to this point is:

```
00002
00003                   ;            CONSTANT AND VARIABLE DECLARATIONS
00004
00005                   ; MEMORY ASSIGNMENTS
00006
00007      1000         MEMSTART EQU 1000H   ;START OF RAM MEMORY
00008      1000         IREADBUF   EQU MEMSTART
00009      100A         RAMSTART EQU MEMSTART+10
00010                   ;        WARNING *WATCH YOUR RAM CLOSELY IT IS ONLY 256 BYTES*
00011      0100         RAMSIZE  EQU 256
00012      1100         STACK    EQU MEMSTART+RAMSIZE
00013
00014
00015
00016      1800         PORTC    EQU  1800H                    ;COPIER I/O PORT
00017      1801         PORT1    EQU  1801H                    ;BIN1 I/O CONTROL WORD
00018      1802         PORT2    EQU  1802H                    ;BIN2 I/O CONTROL WORD
00019      1803         PORT3    EQU  1803H                    ;BIN3 I/O CONTROL WORD
00020      1804         SPARE    EQU  1804H                    ;RESERVED FOR BIN4
00021      1805         RBIN1    EQU  1805H                    ;EXTRA BIN1 INPUTS
00022
00023
00024
00025                           ;CONSTANTS
00026
00027      0000         JSTAT    EQU 00H      ;JOB STATUS WORD (OFFSET FROM RAMSTART)
00028      0001         JBUF     EQU 01H      ;OFFSET FOR JBUF
00029      0002         ESTAT    EQU  02H                      ;ERROR STATUS FLAGS
00030      0003         DFLAG    EQU 03H      ;DISMISS FLAG
00031      0004         SAVE     EQU 04H      ;SAVE (OFFSET)
00032      0005         DIGF     EQU 05H      ;DIGIT FLAG WORD (OFFSET FROM RAMSTART)
00033      0006         CONFIG   EQU 06H      ;OFFSET FOR THE CONFIGURATION.
00034
00035      0003         NBINS    EQU 03H      ;THE NUMBER OF BINS THAT WE ARE CONFIGURED FOR.
00036
00037
00038
00039      100A     >          ORG RAMSTART
00040                   ;RAM ASSIGNMENTS
00041                   ;
00042                   ;
00043 100A 00           IYJSTAT  BYTE 00H                      ;JOB STATUS
00044 100B 00           IYJBUF   BYTE 00H                      ;BUFFERED MODE STATUS
00045 100C 00           IYESTAT  BYTE 00H                      ;ERROR STATUS FLAGS
00046 100D 00           IYDFLAG  BYTE 00H                      ;THE FLAG FOR THE DISMISS ROUTINE.
00047
00048 100E 00           IYSAVE   BYTE 00H                      ;THIS POINTS TO THE CURRENT BIN THAT IS IN USE.
00049 100F 00           IYDIGF   BYTE 00H                      ;DIGIT FLAGS
00050 1010 00           CONFIGU  BYTE 00H                      ;CONFIGURATION  (THE NUMBER OF BINS ATTACHED)
00051
00052
00053 1011 00           COPCT    BYTE 00H                      ;COPY COUNTER FOR COPIER END SENSOR
00054 1012 00           TRANSCNT BYTE 00H                      ;PAPER IN TRANSIT COUNTER  FOR PAPER SUBROUTINE.
00055 1013 00           SHEETCNT BYTE 00H                      ;COUNTER FOR COLLATE MODE (NUMBER OF SHEETS PER POCKET)
00056
00057
00058 1014 0030         RLTBUF   WORD 3000H                    ;REAL TIME TRACE BUFFER FOR DEBUGING
00059 1016 0000         JOBCNT   WORD 00H                      ;JOB COUNTER.
00060 1018 0000         SJOBCNT  WORD 00H                      ;SAVE THE JOB COUNT DURING INTURPT MODE.
00061 101A 0000         SBUFCNT  WORD 00H                      ;SAVE THE BUFFER COUNT.
00062 101C 0000         BUFCNT   WORD 00H                      ;BUFFER FOR TOTAL COUNT OF SHEETS OR BOOKS
00063 101E 0000         NUMBUF   WORD 00H                      ;BUFFER FOR THE INPUT NUMBER.
00064 1020 0000         DIGONE   WORD 00H                      ;BCD    #1 BUFFER
00065 1022 0000         DIGTWO   WORD 00H                      ;BCD    #2 BUFFER
00066 1024 0000         DIGTHREE WORD 00H                      ;BCD    #3 BUFFER
00067 1026 0000         WRITEBUF WORD 00H                      ;POINTS TO THE FIFO FOR WRITEING
00068 1028 0000         READBUF  WORD 00H                      ;POINTS TO THE INPUT BUFFER MUST BE INITIALIZED
00069
00070
00071 102A 0002         TIMER  BLOCK 2
```

```
00072 102C 0002        CTASK   BLOCK 2
00073 102E 0002        PTASK   BLOCK 2
00074
00075
00076
00078                          ;VARIABLES
00079
00080                          ;TIME CONSTANTS
00081
00082
00083      0001        DVD     EQU  1                  ;DIVISOR ADJUSTMENT
00084      0001        MPY     EQU  1                  ;MULTIPLIER ADJUSTMENT
00085
00086      0400        PRFCNT  EQU  0400H*MPY/DVD     THE ENTRY SENSOR JAMCOUNT
00087      0250        JAMCNT  EQU  0250H*MPY/DVD      ;THE PASSED PAPER JAMCOUNT
00088      3000        TRANSTIM EQU 3000H*MPY/DVD      ;THE TRANSIT TIME JAMCOUNT   WORST CASE.
00089      0090        MANCNT  EQU  0090H*MPY/DVD              ;ALLOW TIME FOR THE PAPER TO CLEAR THE MANUAL GATE.
00090      0020        WAIT10  EQU  0020H*MPY/DVD              ;DEBOUNCE DELAY
00091      1000        ENTJAM  EQU  1000H*MPY/DVD      ;THE COPIER TO COLLATOR JAM TIME
00092      1000        BENTJAM EQU  1000H*MPY/DVD      ;FOR COPIER MODEL B TIMEING
00093      0250        MANHOLD EQU  0250H*MPY/DVD      ;THE DEBOUNCE HOLD TIME FOR MANUAL INSERTION.
00094      3000        MANTIME EQU  3000H*MPY/DVD      ;THE MANUAL MODE TIME OUT VALUE.
00095      2000        TURNOFF EQU  2000H*MPY/DVD      ;THE TURNOFF DELAY TIME.
00096      0500        IMIN    EQU  500H*MPY/DVD       ;INTERVAL TIME FOR MANUAL INDEX
00097      3000        TMIN    EQU  3000H*MPY/DVD      ;TIME OUT FOR MANUAL INDEX
00098      0500        PWRDN   EQU  0500H*MPY/DVD      ;PROOF MODE LAST SHEET POWEROFF DELAY.
00099      0500        WAIT500 EQU  0500H*MPY/DVD      ;SEE  STOP    THIS GIVES INDEX A CHANCE TO FINISH.
00100
00101
00102      0064        PKTSZ   EQU  100                ;COLLATE MODE POCKET SIZE.
00103      0032        SPKTSZ  EQU  50                 ;SORT MODE POCKET SIZE.
00104      0014        NUMPKTS EQU  20                 ;THE NUMBER OF POCKETS IN A BIN =20D
00105
00106
00107
00108                  ;DRIVE CODES
00109
00110      0041        DIVC    EQU  41H                ;DIVERTER AND MOTOR
00111      0003        PRFC    EQU  03H                ;PROOF AND MOTOR
00112      0001        DVMC    EQU  01H                ;DRIVE MOTOR ONLY
00113      0011        DNDV    EQU  11H                ;DOWN CLUTCH AND MOTOR
00114      0061        UPDIV   EQU  61H                ;UP CLUTCH AND DIVERTER AND MOTOR
00115      0009        IGATE   EQU  09H                ;MANUAL GATE AND MOTOR
00116      0049        IGATEDIV EQU 49H                ;DIVERTER AND MANUAL GATE AND MOTOR
00117
00118
00119
00120      001F        ERRMSK  EQU  01FH               ;ERROR MASK FOR ESTAT  SEE SORTRDY
00121      001F        MANMSK  EQU  1FH                ;ERROR MASK FOR MANUAL MODE.  SEE PRFTSK
00122      0003        THRES   EQU  03H                ;THRESHOLD FOR PAPER JAM DETECTION
00123      000E        NUMCOM  EQU  000EH      ;THE NUMBER OF COMMANDS IN THE COMTAB
00124      0004        NUMDIG  EQU  0004H      ;THE NUMBER OF ALTERNATE COMMANDS IN THE TABLE.
00125      000F        DIGMSK  EQU  0FH        ;USED TO MASK OUT THE DIGITS.
00126      0001        STROBE  EQU  01H        ;THE DATA STROBE USED IN COPIER-COLLATOR I/O
00127      00FE        ISTROBE EQU  0FEH       ;INVERTED STROBE USED FOR PORT2
00128      00F8        MODMSK  EQU  0F8H       ;THE MODE MASK USED TO SEPERATE THE MODE BITS IN THE JBUF WORD.
00129      0050        STARTMSK EQU 050H          ;THE MODE MASK FOR START   CLEARS THE ERROR FLAGS AND MODE FLAGS.
00130      0003        CMPL    EQU  03H           ;USED BY SENSOR TO COMPLEMENT THE BITS
00131      0003        ROLLOVER EQU 03H           ;CAUSES A ROLLOVER OF THE FIFO BUFFER
00132                  ;
00133                  ;
00134                  ;STACK  EQU  HIGHRAM              ;THE STACK FOR THE OPERATIONS TASK.
00135      1100        SPOPER  EQU  STACK                ;OPERATOR TASK
00136      10E0        SPCJAM  EQU  SPOPER-32            ;THE STACK AREA FOR THE COPIER JAM TASK
00137
00138                  ;THE HOME TASK SHARES THE ALLOW STACK
00139      10C0        SPALLOW EQU  SPCJAM-32            ;THE STACK AREA FOR THE ALLOW MODE CHANGE TASK
00140
00141      10A0        SPPRFTSK EQU SPALLOW-32           ;THE STACK AREA FOR THE PROOF TASK
00142      107C        SPRUNO  EQU  SPPRFTSK-36          ;THE EVEN STACK FOR THE RUN TASK
00143      1058        SPIJAM  EQU  SPRUNO-36            ;INTERLOCK JAM TASK
00144      1038        ENDSTACK EQU SPIJAM-32            ;THE END OF THE STACK IN RAM
00145
00146
00147      0000        OPTEST  EQU  0000H          ;IF WE DECODE A OPTEST THEN LETS DO A RESTART.
00148
00149
00150                          ;OUTPUT CODES FOR RICOH COPIER
00151
00152      0002        PPD     EQU  02H            ;PASSED PAPER DETECTION (TRAY SENSOR) PAPER HAS ENTERED BIN.
00153      0010        SRDY    EQU  10H            ;SORTER READY
00154      0080        JAM1    EQU  080H           ;SORTER JAM TYPE 1
00155      00E0        JAM2    EQU  0E0H           ;SORTER JAM TYPE 2
00156      00B0        JCLEAR  EQU  0B0H           ;JAM RESET CODE
00157      00F0        INTLK   EQU  0F0H           ;INTERLOCK OPEN
00158      0090        MANI    EQU  90H            ;MANUAL INSERTION MODE
00159      00D0        N2B     EQU  0D0H           ;NUMBER TO BIG
00160      00C0        OVFL    EQU  0C0H           ;BIN OVERFLOW
00161      00A0        PINB    EQU  0A0H           ;PAPER IN BIN
00162      0012        CYCEND  EQU  12H            ;MODE CYCLE END
00163      000A        DSHOFF  EQU  0AH            ;DISABLE SHUTOFF
00164      0006        ESHOFF  EQU  06H            ;ENABLE SHUTOFF
00165
00166
00167
00168
00169
00170
00171                          ;JSTAT   JOB STATUS   BIT DEFS
00172
00173
00174      0000        PROOFF  EQU  0H                     ;PROOF MODE FLAG
00175      0001        SORTF   EQU  1H                     ;SORT MODE FLAG
00176      0002        COLLF   EQU  2H                     ;COLLATE MODE FLAG
00177      0003        INTF    EQU  3H                     ;INTRUPT MODE FLAG
00178      0004        COPB    EQU  4H                     ;COPIER <B> FLAG     (MAY NOT BE REQUIRED)
00179      0005        ODIS    EQU  5H   ;DO WE NEED THIS????        ;OUTPUT DISABLE FLAG
00180                  ;ESEN    EQU  6H                     ;END SENSOR FROM COPIER
00181      0007        JAMSTOP EQU  7H                     ;SYSTEM JAM FLAG
```

```
00182
00183
00184
00185                          ;JBUF    JOB BUFFER
00186
00187                  ;PROOFF                                  ;BUFFERED PROOF MODE
00188                  ;SORTF                                   ;BUFFERED SORT MODE
00189                  ;COLLF                                   ;BUFFERED COLLATE MODE
00190      0003        JAMMAN   EQU  3H                         ;JAM MODE  MANUAL INSERTION ENABLE FLAG
00191      0004        MODCHG   EQU  4H                         ;ENABLE MODE CHANGE   (DO A WARM START)
00192      0005        ALLBINS  EQU  5H                         ;SEND ALL THE BINS HOME
00193      0006        STARTF   EQU  6H                         ;JOB START FLAG
00194      0007        ALLOWT   EQU  7H                         ;ALLOW THE MODE CHANGE TASK TO BE STARTED
00195
00196
00197
00198                              ;ESTAT                       ERROR STATUS FLAGS
00199
00200
00201
00202      0000        JAMFLAG  EQU  0H                         ;A COLLATER JAM IS BEING PROCESSED
00203      0001        INTLOK   EQU  1H                         ;INTERLOCK OPEN
00204      0002        ALENB    EQU  2H                         ;ALLOW TASK ENABLE.
00205      0003        NUMERR   EQU  3H                         ;NUMBER ERROR
00206      0005        COLOFF   EQU  5H                         ;THE COLLATOR TURNOFF TASK IS RUNNING   SEE COPJAM.
00207      0006        NEWJOB   EQU  6H                         ;NEW JOB FLAG FOR PROOF MODE.
00208      0007        MANMOD   EQU  7H                         ;MANUAL INSERTION MODE
00210
00211                  ;      INPUT  BIN SENSORS  BIT DEFINITIONS
00212
00213      0000        PSDP     EQU  0H            ;PASSED PAPER            HIGH>TRUE   1=PAPER
00214      0001        PBIN     EQU  1H            ;PAPER IN BIN            HIGH>TRUE    1=PAPER
00215      0002        HOME     EQU  2H            ;HOME SWITCH             LOW>TRUE
00216      0003        JMRST    EQU  3H            ;BIN JAM RESET SWITCH    LOW>TRUE
00217      0004        SLSTOP   EQU  4H            ;SLIDER STOP SWITCH      LOW>TRUE
00218      0005        VANE     EQU  5H            ;VANE SENSOR             LOW>FALSE  0=GAP   1=METAL
00219      0006        MANINX   EQU  6H            ;MANUAL INDEX SWITCH     LOW>TRUE
00220      0007        ENTRY    EQU  7H            ;*ENTRY SENSOR           LOW>TRUE
00221
00222                  ;* ONLY USED ON BIN 1
00223
00224
00225
00226                  ;    OUTPUT BIT DEFINITIONS
00227
00228      0000        DRIVEM   EQU  0H            ;DRIVE MOTOR             HIGH>ON
00229      0001        PRF      EQU  1H            ;*PROOF FINGERS          HIGH>ON
00230                  ;SPARE   EQU  2H            ;NOT USED
00231      0003        INSGATE  EQU  3H            ;*MANUAL INSERTION GATE  HIGH>ON
00232      0004        DOWN     EQU  4H            ;INDEX CLUTCH            HIGH>ON
00233      0005        UP       EQU  5H            ;RESET CLUTCH            HIGH>ON
00234      0006        DIVERT   EQU  6H            ;DIVERTER SELONOID       HIGH>ON
00235                  ;SPARE   EQU  7H            ;NOT USED
00236
00237
00238
00239
00240                  ;   BIN 1  EXTRA INPUTS
00241
00242      0003        MANINS   EQU  3H            ;MANUAL INSERTION SWITCH LOW>TRUE
00243      0004        IN4      EQU  4H            ;INTERLOCK #4            LOW>TRUE
00244      0005        IN3      EQU  5H            ;INTERLOCK #3            LOW>TRUE
00245      0006        IN2      EQU  6H            ;INTERLOCK #2            LOW>TRUE
00246      0007        IN1      EQU  7H            ;INTERLOCK #1            LOW>TRUE
00247
00248
00249
```

OPERATING SYSTEM

```
00253                  ;              MRXZ80 -- MULTITASKING REALTIME EXECUTIVE OPERATING SYSTEM
00254                  ;      COPYRIGHT (C) 1978, 1979,1980 NORFIN, INC.
00255
00256
00257                  ;DATE/TIME OF PRINTOUT
00258                  ;                    ------------------------------------------
00259
00260                  ;      BY      L.B. VANDERHOOF
00261
00262                  ;      VERSION 1.3
00263                  ;      WRITTEN 2 APR 79
00264                  ;      REVISED 09 JUL 79
00265                  ;      11 DEC 79 LBV EXPANDED TO CONTROL 10 BINS
00266                  ;      11 JAN 80 LBV ADDED DIRECT OUTPUT PORT INITIALIZATION
00267
00268                  ;   ** 15 JAN 80  MODIFIED BY E.P. PERRAULT FOR THE RICOH OPERATING SYSTEM
00269
00270
00271
00272                  ;+ +   ****************************************
00273
00274                  ;$ $   MRXZ80: SYSTEM - MULTI-TASKING, REAL TIME, EXECUTIVE
00275
00276                  ;        MRXZ80 IS A REAL TIME, MULTI-TASKING EXECUTIVE THAT TIME SHARES
00277                  ;        THE CPU BETWEEN THE ACTIVE TASKS IN A ONE WAY, SEQUENTIAL, RING-LIST.
00278
00279                  ;        IT UTILIZES THE FOLLOWING SUBROUTINES:
00280                  ;         SWITCH (PART OF INTERRUPT ROUTINE)
00281                  ;         INITNT
00282                  ;         TRMCT
00283                  ;         DISMISS
00284
00285                  ;        EACH ACTIVE TASK REQUIRES A MINIMUM OF 16 BYTES OF RAM FOR ITS
00286                  ;        STACK AREA AND REGISTER STORAGE.  THEREFORE A TASK THAT HAS BEEN
00287                  ;        ASSIGNED 32 BYTES OF RAM SPACE CAN SUPPORT 8 LEVELS OF SUBROUTINE
00288                  ;        CALLS AND/OR PUSHES [ (32-16)/2.= 8 ].
00289
```

```
00290                   ;        TASK RAM DATA STRUCTURE
00291
00292                   ;        A TASK THAT HAS BEEN ASSIGNED 32 BYTES OF RAM AND HAS USED ITS
00293                   ;        8 AVAILABLE LEVELS WOULD LOOK LIKE THIS:
00294
00295                   ;        STACKBASE --->
00296                   ;                -1 --->  POINTER TO TOP OF THIS
00297                   ;                -2 --->  STACK (= STACKBASE-32)
00298                   ;                -3 --->  LINK TO NEXT TASK (POINTS
00299                   ;                -4 --->  TO STACKBASE OF NEXT TASK)
00300                   ;                -5 --->
00301                   ;                  :
00302                   ;                  : --->  TASK STACK ACTIVITY (8 LEVELS)
00303                   ;                  :
00304                   ;               -20 --->
00305                   ;               -21 --->  NEXT ADDRESS IN TASK
00306                   ;               -22 --->  TO BE EXECUTED
00307                   ;               -23 --->  REGISTER A
00308                   ;               -24 --->    *  *   F
00309                   ;               -25 --->    *  *   B
00310                   ;               -26 --->    *  *   C
00311                   ;               -27 --->    *  *   D
00312                   ;               -28 --->    *  *   E
00313                   ;               -29 --->    *  *   H
00314                   ;               -30 --->    *  *   L
00315                   ;               -31 --->    *  *   IX
00316                   ;               -32 --->    *  *   IX  <-- TASK STACK POINTER POINTS HERE
00317
00318
00319                   ;        --NB:  IF TASKS ARE ALLOCATED RAM 32 BYTES APART ANY MORE TASK
00320                   ;               STACK ACTIVITY BEYOND 8 LEVELS WILL CAUSE STACK OVERFLOW.
00321                   ;               (INITNT SUBROUTINE USES 4 LEVELS INCLUDING ITS CALL)
00322
00323
00324                   ;        TASKS:
00325                   ;        (1) CAN BE INITIATED BY OTHER TASKS
00326                   ;        (2) MUST TERMINATE THEMSELVES
00327                   ;        (3) CAN DISMISS THEMSELVES (GIVE UP THEIR
00328                   ;            TIME-SLICE UNTIL THEIR NEXT TURN)
00329
00330
00331                   ;        IF ONLY ONE TASK IS ACTIVE IT CANNOT TERMINATE ITSELF
00332
00333
00334                   ;       ENTRY:
00335                   ;        UNTIL THE FIRST TASK HAS BEEN INITIALIZED INTERRUPTS MUST
00336                   ;        BE DISABLED (ELSE A RATHER PREDICTABLE, UNPREDICTABLE SYSTEM
00337                   ;        FAILURE WILL RESULT)
00338
00339                   ;       EXIT:
00340                   ;        (CTASK) = CURRENT TASK POINTER
00341                   ;        (PTASK) = PREVIOUS TASK POINTER
00342
00343                   ;- -    ******************************************
00345
00346                   ;               DISMISS SUBROUTINE
00347
00348                   ;DISABLE INTERRUPTS - JUMP TO INITIALIZATION ROUTINE
00349
00350      0000     >  RESTART  ORG 0000
00351 0000 F3                  DI
00352 0001 ED56                IM 1
00353 0003 C3DA00   >          JP INTASK
00354 0006 00                  NOP
00355 0007 00                  NOP
00356
00357
00358                   ;+ +    ********************************
00359
00360                   ;$ $    DISMISS: SUBROUTINE - PASS CONTROL TO NEXT SEQUENTIAL TASK
00361
00362                   ;        THIS SUBROUTINE SIMULATES A CLOCK TICK INTERRUPT AND
00363                   ;        THUS TRANSFERS CONTROL TO THE NEXT TASK IN THE
00364                   ;        ROUND-ROBIN SEQUENCE.  CALLED BY THE CURRENT TASK
00365                   ;        IF IT IS WAITING FOR SOMETHING TO HAPPEN THAT HASN'T.
00366
00367                   ;       ENTRY:
00368                   ;        ROUTINE CALLED BY RST 08H
00369                   ;        (CTASK) = CURRENT TASK POINTER
00370                   ;        (PTASK) = PREVIOUS TASK POINTER
00371
00372                   ;       EXIT:
00373                   ;        EXIT IS ABNORMAL VIA TASK SWITCH SUBROUTINE
00374
00375                   ;- -    ********************************
00376
00377
00378                   ;SIMULATE INTERRUPT - SAVE REGISTERS
00379
00380      0008     >          ORG 0008H        ;RESTART 1 LOCATION
00381
00382      0008        DISMISS EQU 08H
00383
00384 0008 F3                  DI               ;(4T) TURN OFF INTERRUPT
00385 0009 F5                  PUSH AF          ;(11T)
00386 000A C5                  PUSH BC          ;(11T)
00387 000B D5                  PUSH DE          ;(11T)
00388 000C E5                  PUSH HL          ;(11T)
00389
00390                   ; GO PUSH IX AND FALL INTO TASK SWITCH SUBROUTINE
00391
00392 000D 1859                JR DISM1         ;(12T) >> EXIT ABNORMALLY <<
00393 000F 00                  NOP
```

```
00395                   ;               WAIT SUBROUTINE
00396
00397
00398                   ;+ +    ********************************
00399
00400                   ;$ $    WAIT: UTILITY SUBROUTINE - WAIT A NUMBER OF COUNTS OF MASTER TIMER
00401
00402                   ;         THIS SUBROUTINE WAITS A SPECIFIED NUMBER OF COUNTS OF THE
00403                   ;         MASTER TIMER LOCATION "TIMER".  IT WILL DISMISS ITSELF (AND THUS
00404                   ;         THE ROUTINE THAT CALLED IT) IF THE TIME DELAY HAS NOT EXPIRED.
00405
00406                   ;       ENTRY:
00407                   ;         CALLED BY RST 10H
00408                   ;         "TIMER" CONTAINS CURRENT +TIME+
00409                   ;         DE = DELAY VALUE COUNT
00410
00411                   ;       EXIT:
00412                   ;         WHEN CURRENT +TIME+ IS GREATER THAN OR EQUAL TO OLD TIME + DELAY COUNT
00413                   ;         EXIT IS VIA SUBROUINE RETURN
00414                   ;         OTHERWISE THERE IS AN ABNORMAL EXIT VIA THE DISMISS ROUTINE
00415
00416                   ;- -    ********************************
00417
00418
00419                   ;GET CURRENT +TIME+ PLUS DELAY COUNT
00420
00421      0010     >          ORG 0010H
00422
00423      0010        WAIT    EQU 10H
00424
00425 0010 DF                  RST TSET
00426
00427                   ;CHECK FOR TIME OUT
00428
00429 0011 E7           WAIT1  RST TTIME
00430 0012 D0                  RET NC          ;TIME IS UP IF CARRY RESET
00431
00432                   ;IF TIME IS NOT EXPIRED, DISMISS UNTIL NEXT TURN
00433
00434 0013 CF                  RST DISMISS
00435
00436                   ;LOOP UNTIL TIME IS UP OR CALLER HAS BEEN TERMINATED
00437
00438 0014 18FB                JR WAIT1
00439 0016 00                  NOP
00440 0017 00                  NOP
00442
00443
00444
00445                   ;+ +    ************************************
00446
00447                   ;$ $    TSET: UTILITY SUBROUTINE - SET TIME EXPIRED VALUE
00448
00449                   ;         THIS SUBROUTINE SETS <DE> TO A TEST VALUE FOR SUBSEQUENT
00450                   ;         TESTING FOR A TIME-OUT.  THIS VALUE IS THE SUM OF THE
00451                   ;         CURRENT VALUE OF "TIMER" AND THE DESIRED DELAY COUNT.
00452
00453                   ;       ENTRY:
00454                   ;         CALLED BY RST 18H  (SINGLE BYTE PAGE 0 CALL TO 18H)
00455                   ;         "TIMER" EQUALS CURRENT +TIME+
00456                   ;         DE = DESIRED DELAY COUNT
00457
00458                   ;       EXIT:
00459                   ;         DE = TIME OUT TEST VALUE
00460                   ;         EXIT IS VIA SUBROUTINE RETURN
00461
00462                   ;- -    ************************************
00463
00464
00465                   ;GET CURRENT +TIME+, ADD TO DELAY COUNT, PUT RESULT IN <DE>
00466
00467      0018     >          ORG 0018H
00468
00469      0018        TSET    EQU 18H
00470
00471 0018 E5                  PUSH HL
00472 0019 2A2A10       >      LD HL,(TIMER)
00473 001C 19                  ADD HL,DE
00474 001D EB                  EX DE,HL
00475 001E E1                  POP HL
00476 001F C9                  RET
00478
00479
00480                   ;+ +    ************************************
00481
00482                   ;$ $    TTIME: UTILITY SUBROUTINE - TEST FOR TIME EXPIRED
00483
00484                   ;         THIS SUBROUTINE TESTS THE TEST VALUE AGAINST THE CURRENT
00485                   ;         VALUE OF "TIMER".  TIME IS UP IF CARRY FLAG RESET.
00486
00487                   ;       ENTRY:
00488                   ;         CALLED BY RST 20H
00489                   ;         "TIMER" = CURRENT +TIME+
00490                   ;         DE = TEST VALUE
00491
00492                   ;       EXIT:
00493                   ;         CARRY FLAG RESET IF TIME EXPIRED
00494                   ;         CARRY FLAG SET IF TIME NOT EXPIRED
00495                   ;         EXIT IS VIA SUBROUTINE RETURN
00496
00497                   ;- -    ************************************
00498
00499
00500                   ;GET CURRENT +TIME+ AND SUBTRACT TEST VALUE
00501
00502      0020     >          ORG 20H
00503
00504      0020        TTIME   EQU 20H
00505
```

```
00506 0020 E5                PUSH HL
00507 0021 2A2A10  >         LD HL,(TIMER)
00508 0024 B7                OR A            ;CLEAR CARRY
00509 0025 ED52        TTIM1 SBC HL,DE
00510 0027 37                SCF
00511 0028 FA2C00  >         JP M,TTIM2
00512 002B 3F                CCF
00513
00514                  ; IF CARRY RESET, THEN TIME HAS EXPIRED
00515
00516 002C E1          TTIM2 POP HL
00517 002D C9                RET
00518
00519 002E 56414E44            ASCII "VANDERHOOF"
00519 0032 4552484F
00519 0036 4F46
00520
00522                  ;+ +   ******************************************
00523
00524                  ;$ $   INTRTP: INTERRUPT SERVICE ROUTINE
00525
00526                  ;        THIS ROUTINE DOES WHATEVER IS REQUIRED FOR EACH INTERRUPT
00527                  ;        AND, JUST BEFORE LEAVING PERFORMS A TASK SWITCH TO THE
00528                  ;        NEXT SEQUENTIAL TASK
00529
00530                  ;      ENTRY:
00531                  ;        2 BYTE RAM LOCATION "TIMER"
00532
00533                  ;      EXIT:
00534                  ;        "TIMER" INCREMENTED BY 1
00535                  ;        READ DATA FROM COPIER.
00536                  ;        NEW OUTPUT PORTS IMAGE TO OUTPUT
00537                  ;        OLD CURRENT TASK IS NOW PREVIOUS TASK
00538                  ;        NEW CURRENT TASK IS THE NEXT SEQUENTIAL TASK
00539
00540                  ;- -   ***************************************
00541
00542      0038    >         ORG 38H          ;FOR MODE 1 INTERRUPT
00543
00544                  ;SAVE REGISTERS
00545
00546                  ; INT ACK AND RST  (6+11 = 17T)
00547
00548 0038 F3          INTRTP DI
00549 0039 F5                 PUSH AF         ;(11T)
00550 003A C5                 PUSH BC         ;(11T)
00551 003B D5                 PUSH DE         ;(11T)
00552 003C E5                 PUSH HL         ;(11T)
00553 003D DDE5               PUSH IX         ;(15T)
00554
00555                  ;DO WHATEVER IS NECESSARY HERE
00556
00557                  ;COPY RAM IMAGE TO OUTPUT PORTS
00558
00559                  ;??????????????????????????????
00560                  ;        LD   BC,0005H
00561                  ;        LD   DE,OUTPORTS
00562                  ;        LD   HL,OUTRAM
00563                  ;        LDIR
00564
00565
00566                  ;IF JOB BUSY$=TRUE THEN DO NOT SWITCH TASKS
00567
00568                  ;??????????????????????
00569                  ;        BIT   JBUSY,(IY+JSTAT)
00570                  ;        JR    NZ,NOSWITCH
00571
00572
00573                  ;INCREMENT MASTER +TIME+ CLOCK
00574
00575 003F 2A2A10  >         LD HL,(TIMER) ;(16T)
00576 0042 23                INC HL        ;(6T)
00577 0043 222A10  >         LD (TIMER),HL ;(16T)
00578
00579
00580                  ;IF INPUT$=TRUE THEN READ THE INPUT AND SAVE IT
00581
00582 0046 CDC106  >           CALL  READ
00583
00584
00585
00586                  ;IF DISMISS$=TRUE THEN GIVE THIS TASK ITS FULL TIME SLOT.
00587
00588
00589 0049 FDCB0326            SLA  (IY+DFLAG)              ;RESET THE DISMISS FLAG AND TEST IT
00590 004D 3839                JR   C,NOSWITCH
00591 004F 181D                JR   SWITCH            ;GET AROUND THE NMI ENTRY
00592
00593 0051 414E4420            ASCII "AND E PERRAULT"
00593 0055 45205045
00593 0059 52524155
00593 005D 4C54
00594
00595
00596      0066    >           ORG 66H
00597
00598 0066 1898                JR  RESTART   ;NMI RESTART IF YOU SEE THIS.
00599
00601
00602
00603                  ;+ +   ***************************************
00604
00605                  ;$ $   SWITCH: SUBROUTINE - SET UP NEXT SEQUENTIAL TASK TO RUN
00606
00607                  ;        THIS ROUTINE PERFORMS A ROUND-ROBIN SEQUENTIAL TASK SWITCH
00608                  ;        IT SETS THE CURRENT TASK TO BE THE PREVIOUS TASK AND
00609                  ;        LOADS THE REGISTERS FOR THE NEW CURRENT TASK.
00610                  ;        IT IS ENTERED AT THE EXPIRATION OF A TIME SLICE
```

```
00611                   ;         (CLOCK-TICK INTERRUPT), WHEN A TASK IS TERMINATING
00612                   ;         ITSELF (JUMP TO SWX), OR WHEN A TASK IS DISMISSING
00613                   ;         ITSELF (JUMP TO SWITCH).
00614
00615                   ;         --NB: THE CONTENTS OF (CTASK) AND (PTASK) ALWAYS POINT TO THE BASE OF
00616                   ;               THE STACK FOR THE CURRENT TASK AND THE PREVIOUS TASK, RESPECTIVELY
00617
00618
00619                   ;       ENTRY:
00620                   ;         (CTASK)=CURRENT TASK POINTER
00621                   ;         (PTASK)=PREVIOUS TASK POINTER
00622
00623                   ;       EXIT:
00624                   ;         (CTASK)=NEW CURRENT TASK POINTER
00625                   ;         (PTASK)=PREVIOUS TASK POINTER
00626                   ;         REGISTERS FOR NEW CURRENT TASK ARE RESTORED
00627                   ;         EXIT IS VIA SUBROUTINE RETURN
00628
00629                   ;- -    ****************************************
00630
00631
00632                   ; FINISH DISMISS SUBROUTINE (PUSH IX, THEN FALL INTO TASK SWITCH)
00633
00634 0068 DDE5         DISM1  PUSH IX
00635 006A FDCB03FE            SET  7,(IY+DFLAG)              ;SET THE DISMISS FLAG
00636
00637                   ;MOVE THE CURRENT TASK POINTER TO THE PREVIOUS TASK POINTER
00638
00639 006E 2A2C10  >    SWITCH LD HL,(CTASK)    ;(16T)
00640 0071 222E10  >           LD (PTASK),HL    ;(16T)
00641
00642                   ;GRAB THE STACK POINTER
00643
00644 0074 210000       SWX    LD HL,0          ;(10T)
00645 0077 39                  ADD HL,SP        ;(11T)
00646
00647                   ;MOVE CURRENT TASK POINTER TO SP
00648
00649 0078 ED7B2C10>           LD SP,(CTASK)    ;(20T)
00650
00651                   ;SAVE THE STACK POINTER OF THE CURRENT TASK
00652
00653 007C E5                  PUSH HL          ;(11T)
00654
00655                   ;PICK UP LINK POINTER TO NEXT SEQUENTIAL TASK
00656
00657 007D 3B                  DEC SP           ;(6T)
00658 007E 3B                  DEC SP           ;(6T)
00659 007F E1                  POP HL           ;(11T)  <HL> IS NOW NEW CURRENT TASK POINTER
00660
00661                   ; UPDATE CURRENT TASK POINTER
00662
00663 0080 222C10  >           LD (CTASK),HL    ;(16T)
00664
00665                   ;LOAD THE STACK POINTER FOR THE NEW CURRENT TASK
00666
00667 0083 F9                  LD SP,HL         ;(6T)
00668 0084 3B                  DEC SP           ;(6T)
00669 0085 3B                  DEC SP           ;(6T)
00670 0086 E1                  POP HL           ;(11T)
00671 0087 F9                  LD SP,HL         ;(6T)
00672
00673                   ;END OF TASK SWITCH
00674                   ;RESTORE REGISTERS OF NEW CURRENT TASK
00675
00676 0088 DDE1         NOSWITCH POP IX          ;(14T)
00677 008A E1                    POP HL          ;(10T)
00678 008B D1                    POP DE          ;(10T)
00679 008C C1                    POP BC          ;(10T)
00680 008D F1                    POP AF          ;(10T)
00681 008E FB                    EI              ;(4T)  READY AGAIN
00682 008F C9                    RET             ;(10T)
00684
00685                   ;+ +    ****************************
00686
00687                   ;$ $    INITNT: SUBROUTINE - BUILD STACK AREA FOR NEW TASK
00688
00689                   ;         THIS ROUTINE SPLICES A NEW TASK INTO THE RING-LIST
00690                   ;         OF ACTIVE TASKS.  IT BUILDS A STACK AREA FOR THE NEW
00691                   ;         TASK (STACK AREA PLUS POINTERS)
00692                   ;         THE NEWLY CREATED TASK EXECUTES IMMEDIATELY FOLLOWING
00693                   ;         THE TASK THAT CREATED IT.
00694                   ;         ONE 2 BYTE PARAMETER MAY BE PASSED TO THE NEW TASK
00695                   ;         IN THE BC REGISTER.  WHEN THE TASK STARTS EXECUTION
00696                   ;         THE PARAMETER IS LOADED INTO IX.
00697
00698                   ;       ENTRY:
00699                   ;         BC = PARAMETER TO BE PASSED TO NEW TASK
00700                   ;         DE = STACK BASE ADDRESS OF NEW TASK
00701                   ;         HL = NEW TASK ENTRY ADDRESS
00702                   ;         (CTASK) = CURRENT TASK POINTER
00703
00704                   ;       EXIT:
00705                   ;         STACK DATA STRUCTURE OF NEWLY CREATED TASK
00706
00707                   ;         STACKBASE --->
00708                   ;                -1 --->  POINTER TO TOP OF THIS     HI
00709                   ;                -2 --->  STACK (= STACKBASE-16)     LO
00710                   ;                -3 --->  LINK TO NEXT TASK (POINTS  HI
00711                   ;                -4 --->  TO STACKBASE OF NEXT TASK) LO
00712                   ;                -5 --->  TASK ENTRY ADDRESS         HI
00713                   ;                -6 --->   •    •    •              LO
00714                   ;                 :
00715                   ;                 :
00716                   ;               -15 --->  PASSED PARAMETER          HI
00717                   ;               -16 --->  PASSED PARAMETER          LO
00718
00719                   ;         BECAUSE INTERRUPT DISABLED IY IS USED.  ALL
```

```
00720                   ;        OTHER REGISTERS EXCEPT IX ARE GARBAGE....
00721                   ;        REQUIRES 3 LEVELS OF STACK SPACE (INCLUDING ORIGINAL CALL)
00722                   ;        ON CALLER'S STACK
00723                   ;        EXIT IS VIA SUBROUTINE RETURN
00724
00725                   ;- -   ################################
00726
00727
00728                   ; SAVE PARAMETER AND NEW TASK ENTRY ADDRESS
00729
00730 0090 F3           INITNT DI
00731 0091 C5                  PUSH BC
00732 0092 E5                  PUSH HL
00733
00734                   ;PICK UP CURRENT TASK POINTER
00735
00736 0093 FD2A2C10>           LD IY,(CTASK)
00737
00738                   ;REPLACE THE LINK POINTER IN THE CURRENT TASK
00739                   ;STACK AREA WITH A POINTER TO THE NEW TASK
00740
00741 0097 FD46FD              LD B,(IY-3)      ;PICK UP 'OLD' LINK
00742 009A FD4EFC              LD C,(IY-4)
00743 009D FD72FD              LD (IY-3),D      ;SET NEW LINK
00744 00A0 FD73FC              LD (IY-4),E
00745
00746                   ;NOW BUILD THE INITIAL STACK AREA FOR THE NEW TASK
00747
00748 00A3 21F0FF              LD HL,-16
00749 00A6 19                  ADD HL,DE
00750 00A7 EB                  EX DE,HL
00751
00752                   ;DE NOW CONTAINS THE TOP-OF-STACK POINTER FOR THE
00753                   ;NEW TASK.  (16 BYTES BELOW THE STACK BASE)
00754
00755 00A8 2B                  DEC HL
00756 00A9 72                  LD (HL),D        ;SAVE T-O-S POINTER
00757 00AA 2B                  DEC HL
00758 00AB 73                  LD (HL),E
00759
00760                   ;PUT 'OLD' LINK IN THE NEW TASK STACK AREA
00761                   ;TO RESTORE LIST CONTINUITY
00762
00763 00AC 2B                  DEC HL
00764 00AD 70                  LD (HL),B
00765 00AE 2B                  DEC HL
00766 00AF 71                  LD (HL),C
00767
00768                   ;PUT NEW TASK ENTRY ADDRESS IN PLACE
00769
00770 00B0 C1                  POP BC
00771 00B1 2B                  DEC HL
00772 00B2 70                  LD (HL),B
00773 00B3 2B                  DEC HL
00774 00B4 71                  LD (HL),C
00775
00776                   ;PLACE PASSED PARAMETER
00777
00778 00B5 C1                  POP BC
00779 00B6 11F7FF              LD DE,-9
00780 00B9 19                  ADD HL,DE
00781 00BA 70                  LD (HL),B
00782 00BB 2B                  DEC HL
00783 00BC 71                  LD (HL),C
00784
00785                   ;THE STACK FOR THE NEW TASK HAS NOW BEEN
00786                   ;BUILT.  RETURN CONTROL TO CURRENT TASK.
00787
00788 00BD FD210A10            LD IY,RAMSTART   ; RELOAD IY
00789 00C1 FB                  EI
00790 00C2 C9                  RET              ;<< EXIT >>
00792
00793                   ;+ +   ################################
00794
00795                   ;$ $   TRMCT: SUBROUTINE - A TASK TERMINATES ITSELF
00796
00797                   ;        THIS SUBROUTINE TERMINATES THE TASK CURRENTLY
00798                   ;        EXECUTING AND PASSES CONTROL TO THE NEXT SEQUENTIAL TASK.
00799                   ;        IT WILL NOT RUN AGAIN UNLESS RE-INITILIZED BY INITNT.
00800                   ;        THE CURRENT TASK IS UNSPLICED FROM THE RING BY ALTERING
00801                   ;        THE LINK POINTER OF THE PREVIOUS TASK TO POINT TO THE
00802                   ;        TASK FOLLOWING THE CURRENT TASK.
00803
00804                   ;      ENTRY:
00805                   ;        (CTASK) = CURRENT TASK POINTER
00806                   ;        (PTASK) = PREVIOUS TASK POINTER
00807
00808                   ;      EXIT:
00809                   ;        EXIT IS ABNORMAL VIA A JUMP TO THE TASK SWITCHING ROUTINE
00810                   ;        USES BC,IX
00811
00812                   ;- -   ##########################################
00813
00814
00815                   ;MOVE THE LINK POINTER OF THE CURRENT TASK TO THE
00816                   ;PREVIOUS TASK, THUS REMOVING THE CURRENT TASK FROM
00817                   ;THE RING.
00818
00819 00C3 F3           TRMCT  DI
00820 00C4 DD2A2C10>           LD IX,(CTASK)
00821 00C8 DD46FD              LD B,(IX-3)
00822 00CB DD4EFC              LD C,(IX-4)
00823 00CE DD2A2E10>           LD IX,(PTASK)
00824 00D2 DD70FD              LD (IX-3),B
00825 00D5 DD71FC              LD (IX-4),C
00826
00827                   ;NOW SWITCH CONTROL TO NEXT TASK
00828
00829 00D8 189A                JR SWX           ;>> EXIT ABNORMALLY <<
```

```
00831                          LIST
00832
00833                    ;INITIALIZE THE SYSTEM
00834                    ;
00835                    ;
00836                    ;
00837
00838                    ; DIRECTLY INITIALIZE OUTPUT PORTS
00839
00840 00DA 3EFF          INTASK  LD A,0FFH                ; ONES IS OFF
00841 00DC 320018               LD (PORTC),A             ;SEND INVERTED ZERO TO COPIER.
00842
00843                    ;FILL RAM WITH ZEROS
00844
00845 00DF 01FF00               LD BC,RAMSIZE-1          ; BYTE COUNT
00846 00E2 110110               LD DE,MEMSTART+1         ; DESTINATION
00847 00E5 210010               LD HL,MEMSTART           ; SOURCE
00848 00E8 3600                 LD (HL),0                ; SAMPLE BYTE
00849 00EA EDB0                 LDIR                     ; DO ALL REST LIKE SAMPLE
00850
00851
00852 00EC 210030               LD HL,3000H     ;THIS IS FOR A TEST BUFFER.   LOOK AT SYSCOM
00853 00EF 221410  >            LD  (RLTBUF),HL
00854
00855
00856
00857                    ; SET FLAG INDEX REGISTER
00858
00859                    ;THIS WILL BE DONE BY INITIALIZE NEW TASK.
00860                    ;        LD IY,RAMSTART
00861
00862                    ;SET UP THE READ BUFFER
00863
00864 00F2 210010                LD   HL,IREADBUF
00865 00F5 222B10  >             LD   (READBUF),HL
00866 00F8 222610  >             LD   (WRITEBUF),HL
00867
00868                    ;INITIALIZE THE CONTROL AND STATUS WORDS
00869
00870 00FB 3E01          RESET   LD   A,1
00871 00FD 320B10  >             LD   (IYJBUF),A                ;SET PROOF MODE
00872 0100 6F                    LD   L,A
00873 0101 AF                    XOR  A
00874 0102 67                    LD   H,A
00875 0103 221E10  >             LD   (NUMBUF),HL               ;SET ONE COPY
00876
00877 0106 3A0518                LD   A,(RBIN1)
00878                    ;OLD MASK WAS 38H  NEW MASK IS 70H
00879 0109 E670                  AND 70H     ;JUST GET THE INTERLOCK BITS FOR BINS 2 THRU 4
00880                    ;ASSUME THAT BIN 1 IS CONNECTED.
00881
00882 010B 321010  >             LD   (CONFIGU),A     ;THIS POWER UP CONFIGURATION IS USED TO INDICATE
00883                            ;HOW MANY BINS ARE CONNECTED.
00884
00885
00886
00887
00888                    ; SET UP FIRST TASK PARAMETERS
00889
00890 010E 210011        WRMSTART LD   HL,STACK
00891 0111 F9                   LD SP,HL
00892 0112 E5                   PUSH HL
00893 0113 E5                   PUSH HL
00894 0114 222C10  >            LD (CTASK),HL
00895 0117 222E10  >            LD (PTASK),HL
00896
00897                    ;       LD   HL,(CTASK)          ;DURING A WARM START THIS PREVENTS THE CURRENT TASK FROM
00898                    ;       LD   (PTASK),HL          ;BEING DROPED OUT OF THE RING.
00899 011A 115B10               LD   DE,SPIJAM          ;START THE INTERLOCK JAM ROUTINE
00900 011D 212403  >            LD   HL,IJAM
00901 0120 CD9000  >            CALL INITNT
00902
00903 0123 117C10               LD   DE,SPRUNO         ;START THE RUN TASK
00904 0126 214D04  >            LD   HL,RUN
00905 0129 CD9000  >            CALL INITNT
00906 012C 11A010               LD   DE,SPPRFTSK               ;START THE PROOF TASK
00907 012F 217C05  >            LD   HL,PRFTSK
00908 0132 CD9000  >            CALL INITNT
00909
00910
00911 0135 FDCB02F6             SET  NEWJOB,(IY+ESTAT)         ;THIS IS FOR THE PROOF MODE.
00912 0139 FD360401             LD   (IY+SAVE),01H             ;SET TO BIN 1
00913 013D FDCB0166             BIT  MODCHG,(IY+JBUF)
00914 0141 FDCB01A6             RES  MODCHG,(IY+JBUF)
00915 0145 C29001  >            JP   NZ,STARTO
00916                    ;;;;   JP   OPER                      ;GO TO THE OPERATIONS TASK.
00920                    ;
00921                    ;
00922                    ;OPERATING SYSTEM FOR RICOH COLLATOR
00923                    ;COPYRIGHT  (C)  1980 FOR NORFIN INC.
00924                    ;ALL RIGHTS RESERVED.
00925                    ;
00926                    ;
00927                    ;    BY ERIC P. PERRAULT
00928                    ;       JANUARY 1980
00929                    ;
00930                    ;
00931                    ;
00932                    ;
00933                    ;
00934                    ;
00935                    ;
00936                    ;THIS TASK IS STARTED AT POWER UP AND NEVER TERMINATES.
00937                    ;
00938                    ;THE PURPOSE OF THIS TASK IS TO INTERPET THE DATA SENT BY THE COPIER
00939                    ; AND RESPOND IN AN APPROPIATE MANNER.
00940                    ;
00941                    ;ENTRY:CHECKS THE READ BUFFER FOR DATA.
00942                    ;
```

```
00943                   ;EXIT:JUMPS TO THE COMMAND SUBSECTION AND DISMISSES.
00944                   ;
00945                   ;
00946                   ;
00947                   ;*******************
00948                   ;THIS HAS BEEN CHANGED TO A FIFO BUFFER
00949 0148 214801  >    OPER     LD   HL,OPER                  ;SET UP THE RETURN ADDRESS.
00950 014B E5                    PUSH HL
00951 014C 2A2810  >    OPER1    LD   HL,(READBUF)             ;OFFSET$:=COMMAND VALUE$
00952 014F 7E                    LD   A,(HL)                   ;IF OFFSET$=? THEN DISMISS
00953 0150 A7                    AND  A
00954 0151 2002                  JR   NZ,OPER2
00955 0153 CF                    RST  DISMISS
00956 0154 C9                    RET
00957
00958 0155 4F           OPER2    LD   C,A
00959 0156 3600                  LD   (HL),00H                 ;CLEAR THE BUFFER
00960 0158 23                    INC  HL                       ;ELSE   UPDATE THE POINTER
00961 0159 46                    LD   B,(HL)                   ;GOTO           COMMAND JUMP TABLE$(OFFSET$)
00962 015A 3600                  LD   (HL),00H                 ;CLEAR THE BUFFER
00963 015C 23                    INC  HL
00964                   ;*************** CAREFUL WITH THIS ONE ********
00965                   ;VALUE OF IREADBUF IS CRITICAL
00966
00967 015D CB9D                  RES  ROLLOVER,L
00968
00969 015F 222810  >             LD   (READBUF),HL             ;(*UPDATE THE POINTER*)
00970
00971
00972                   ;        DI
00973                   ;        LD   HL,(RLTBUF)              ;MONITOR THE INPUTS TO OPERATOR.
00974                   ;        LD   (HL),0DDH
00975                   ;        INC  HL
00976                   ;        LD   (HL),C                   ;<C>=COMMAND
00977                   ;        INC  HL
00978                   ;        LD   (HL),B                   ;<B>=BCD NUMBER
00979                   ;        INC  HL
00980                   ;        LD   (RLTBUF),HL
00981                   ;        EI
00982
00983 0162 212307  >             LD   HL,CJPTAB
00984 0165 87                    ADD  A,A
00985 0166 5F                    LD   E,A
00986 0167 AF                    XOR  A
00987 0168 57                    LD   D,A
00988 0169 19                    ADD  HL,DE
00989 016A 5E                    LD   E,(HL)
00990 016B 23                    INC  HL
00991 016C 56                    LD   D,(HL)
00992 016D EB                    EX   DE,HL
00993 016E E9                    JP   (HL)                     ;(*DO WHATEVER IS REQUIRED*)
00994                   ;
00995                   ;
00996                   ;
00997                   ;
00998                   ;
00999 016F F3           ENDSEN   DI
01000 0170 3A1110  >             LD   A,(COPCT)                ;END SENSOR  (*ADVANCE THE COPIER COUNTER*)
01001 0173 3C                    INC  A
01002 0174 321110  >             LD   (COPCT),A
01003 0177 FB                    EI
01004 0178 C9                    RET                           ;END OF PAPER
01005                   ;
01006                   ;
01007 0179 FDCB00E6     P1MOD    SET  COPB,(IY+JSTAT)          ;THIS IS COPIER B
01008 017D C9                    RET
01009                   ;
01010                   ;
01011 017E FDCB0046     MODOFF   BIT  PROOFF,(IY+JSTAT)        ;IF PROOF MODE$=TRUE THEN ENABLE SHUTOFF
01012 0182 2007                  JR   NZ,MODOFF1
01013 0184 CDDE03  >             CALL SENSOR
01014                   ;        BIT  PBIN,A                   ;IF PAPER IN BIN$=FALSE THEN ENABLE SHUTOFF
01015 0187 3E0A                  LD   A,DSHOFF
01016 0189 2802                  JR   Z,MODOFF2
01017 018B 3E06         MODOFF1  LD   A,ESHOFF                 ;EXIT THRU OUTPUT
01018 018D C34F07  >    MODOFF2  JP   OUTPUT
01019                   ;
01020                   ;
01021
01022
01023 0190 214801  >    START0   LD   HL,OPER                  ;THIS IS FOR WRMSTART
01024 0193 E5                    PUSH HL
01025 0194 FDCB019E              RES  JAMMAN,(IY+JBUF)
01026 0198 FDCB0286              RES  JAMFLAG,(IY+ESTAT)
01027 019C FDCB02BE              RES  MANMOD,(IY+ESTAT)
01028 01A0 CF                    RST  DISMISS                  ;GIVE EVERYONE A CHANCE TO SETTLE
01029 01A1 FDCB005E     START    BIT  INTF,(IY+JSTAT)          ;CHECK FOR INTERUPT MODE.
01030 01A5 2806                  JR   Z,START1
01031                   ;DO SOMETHING HERE, LIKE QUIT?
01032 01A7 FDCB00C6              SET  PROOFF,(IY+JSTAT)
01033 01AB 181B                  JR   START4
01034
01035
01036 01AD FDCB0166     START1   BIT  MODCHG,(IY+JBUF)
01037 01B1 C20E01  >             JP   NZ,WRMSTART
01038 01B4 FDCB019E     START2   RES  JAMMAN,(IY+JBUF )
01039 01B8 F3                    DI
01040 01B9 3A0B10  >             LD   A,(IYJBUF)               ;SET UP THE JOB STATUS
01041 01BC E607                  AND  07H
01042 01BE 4F                    LD   C,A
01043 01BF 3A0A10  >             LD   A,(IYJSTAT)
01044 01C2 E650                  AND  STARTMSK
01045 01C4 B1           START3   OR   C
01046 01C5 320A10  >             LD   (IYJSTAT),A
01047 01C8 FB           START4   EI
01048 01C9 FDCB02AE              RES  COLDFF,(IY+ESTAT)
01049 01CD 2A1E10  >             LD   HL,(NUMBUF)
01050 01D0 221C10  >             LD   (BUFCNT),HL
```

```
01051 01D3 CD0203  >  START5   CALL UNFREZE                    ;THIS IS ALSO USED BY JAMTSK
01052 01D6 4F                  XOR  A
01053 01D7 321110  >           LD   (COPCT),A                 ;RESET THE COPY COUNT
01054 01DA 321210  >           LD   (TRANSCNT),A
01055 01DD FDCB01F6            SET  STARTF,(IY+JBUF)
01056 01E1 C9                  RET
01057
01058
01059 01E2 FDCB026E   COPJAM   BIT  COLOFF,(IY+ESTAT)
01060 01E6 C0                  RET  NZ
01061 01E7 11E010     COPJAM1  LD   DE,SPCJAM                 ;START THE CYCLE DOWN COPIER JAM TASK
01062 01EA 21D002  >           LD   HL,CJAM
01063 01ED CD9000  >           CALL INITNT                    ;EXIT THRU INITNT
01064 01F0 CF                  RST  DISMISS
01065 01F1 C9                  RET
01066                 ;
01067                 ;
01068                 ;THIS IS NO LONGER REQUIRED
01069 01F2 C9         JRESET   RET
01070                 ;
01071                 ;
01072 01F3 FDCB01B6   STOP     RES  STARTF,(IY+JBUF)
01073 01F7 110005              LD   DE,WAIT500
01074 01FA D7                  RST  WAIT
01075 01FB C30604  >           JP   ALLOFF
01076                 ;
01077                 ;
01078                 ;
01079 01FE 0601       PROOF    LD   B,01H                 ;SET PROOF MODE
01080 0200 1806                JR   SETMOD
01081
01082
01083
01084 0202 0604       COLL     LD   B,04H                 ;SET COLLATE MODE
01085 0204 1802                JR   SETMOD
01086                 ;
01087                 ;
01088 0206 0602       SORT     LD   B,02H                 ;SET SORT MODE
01089                 ;
01090                 ;
01091 0208 F3         SETMOD   DI
01092 0209 FDCB01E6            SET  MODCHG,(IY+JBUF)
01093 020D 3A0B10  >           LD   A,(IYJBUF)
01094 0210 E6FB                AND  MODMSK
01095 0212 B0                  OR   B
01096 0213 320B10  >           LD   (IYJBUF),A
01097 0216 CB7F                BIT  ALLOWT,A
01098 0218 C0                  RET  NZ
01099 0219 CBFF                SET  ALLOWT,A
01100 021B 320B10  >           LD   (IYJBUF),A
01101 021E 11C010              LD   DE,SPALLOW
01102 0221 21A603  >           LD   HL,ALLOW
01103 0224 C39000  >           JP   INITNT
01104                 ;
01105                 ;
01106                 ;INTRPT   BIT  INTF,(IY+JSTAT)
01107                 ;         JR   NZ,INTRPT1
01108 0227 FDCB00DE   INTRPT   SET  INTF,(IY+JSTAT)
01109 022B 2A1C10  >           LD   HL,(BUFCNT)
01110 022E 221A10  >           LD   (SBUFCNT),HL
01111 0231 2A1610  >           LD   HL,(JOBCNT)
01112 0234 221810  >           LD   (SJOBCNT),HL
01113 0237 C3F301  >           JP   STOP
01114 023A FDCB009E   INTRPT1  RES  INTF,(IY+JSTAT)       ;COULD BE A TIMEING PROBLEM HERE IF COPIER SENDS DATA
01115 023E 2A1A10  >           LD   HL,(SBUFCNT)
01116 0241 221E10  >           LD   (NUMBUF),HL           ;WHEN THE OPERATOR PUSHES START THE NUMBUF WILL
01117 0244 2A1810  >           LD   HL,(SJOBCNT)          ;BE LOADED INTO THE BUFCNT
01118 0247 221610  >           LD   (JOBCNT),HL
01119 024A FDCB00B6            RES  PROOFF,(IY+JSTAT)     ;THIS IS REQUIRED TO RESTORE THE PRIOR JOB INTACT.
01120 024E FDCB01A6            RES  MODCHG,(IY+JBUF)
01121 0252 C9                  RET
01122                 ;
01123                 ;
01124                 ;
01125                 ;
01126 0253 ED432210>  SECDIG   LD   (DIGTWO),BC
01127 0257 C9                  RET
01128                 ;
01129                 ;
01130 0258 ED432410>  THDIG    LD   (DIGTHREE),BC
01131                 ;        SET  COPR,(IY+JSTAT)          ;NOT REQUIRED BUT COULD BE USEFUL.
01132 025C C9                  RET
01133
01134
01135 025D ED432010>  FIRDIG   LD   (DIGONE),BC
01136
01137
01138                 ;CONVERT DIGITS
01139 0261 AF                  XOR  A
01140 0262 212110  >           LD   HL,DIGONE+1
01141 0265 ED6F                RLD
01142 0267 23                  INC  HL
01143 026B 23                  INC  HL
01144 0269 B6                  OR   (HL)
01145 026A 4F                  LD   C,A
01146 026B 23                  INC  HL
01147 026C 23                  INC  HL
01148 026D AF                  XOR  A
01149 026E ED67                RRD
01150
01151
01152
01153                 ;        DI                            ;MONITER THE BCD NUMBERS
01154                 ;        LD   HL,(RLTBUF)
01155                 ;        LD   (HL),0EEH
01156                 ;        INC  HL
01157                 ;        LD   (HL),C
01158                 ;        INC  HL
```

```
01159                   ;       LD    (RLTBUF),HL
01160                   ;       EI
01161
01162
01163
01164 0270 CDAF02  >            CALL BCDBIN
01165 0273 221E10  >            LD   (NUMBUF),HL
01166 0276 FDCB01E6             SET  MODCHG,(IY+JBUF)          ;IF THEY CHANGE THE NUMBER THEN WE RESTART
01167
01168 027A FDCB005E   CONDIG    BIT  INTF,(IY+JSTAT)           ;IF INTERRUPT MODE THEN EXIT
01169 027E C0                   RET  NZ
01170 027F FDCB0156             BIT  COLLF,(IY+JBUF)           ;ELSE IF THIS IS THE COLLATE MODE THEN CHECK
01171 02B3 281A                 JR   Z,TEST1                   ;THIS IS NOT THE COLLATE MODE SO FORGET IT.
01172
01173                   ;DO A NUMBER TO BIG CHECK HERE.
01174
01175 0285 3A1010  >    CONDIG1 LD   A,(CONFIGU)
01176 0288 011400               LD   BC,NUMPKTS                ;NUMBER OF POCKETS PER BIN = 20 DECIMAL
01177 028B 2B                   DEC  HL                        ;ADJUST FOR >=
01178 028C B7                   OR   A                         ;CLEAR THE CARRY
01179 028D ED42                 SBC  HL,BC
01180 028F CB77                 BIT  IN2,A
01181 0291 200A                 JR   NZ,TEST
01182 0293 B7                   OR   A
01183 0294 ED42                 SBC  HL,BC
01184 0296 CB6F                 BIT  IN3,A
01185 0298 2003                 JR   NZ,TEST
01186 029A B7                   OR   A
01187 029B ED42                 SBC  HL,BC
01188
01189                   ;BIN 4 IS THE SAME
01190
01191 029D 3007         TEST    JR   NC,TEST2  ;IF NUMBER OF BOOKS - NUMBER OF POCKETS IS NEGATIVE THEN NO ERROR
01192 029F FDCB029E     TEST1   RES  NUMERR,(IY+ESTAT)
01193 02A3 C34507  >            JP   SORTRDY
01194
01195
01196                   ;       DI                     ;MONITER THE ERROR VALUES      (REMAINDER) (BINARY NUMBER)
01197                   ;       EX DE,HL
01198                   ;       LD   HL,(RLTBUF)
01199                   ;       LD   (HL),0FFH
01200                   ;       INC  HL
01201                   ;       LD   (HL),E
01202                   ;       INC  HL
01203                   ;       LD   DE,(NUMBUF)
01204                   ;       LD   (HL),E
01205                   ;       INC  HL
01206                   ;       LD   (RLTBUF),HL
01207                   ;       EI
01208
01209
01210 02A6 FDCB02DE     TEST2   SET  NUMERR,(IY+ESTAT)
01211 02AA 3ED0                 LD   A,N2B                     ;ELSE ERROR
01212 02AC C34F07  >            JP   OUTPUT                    ;EXIT THRU OUTPUT
01213                   ;       RET
01214
01215
01216
01217
01218
01219
01220                   ;
01221                   ;THIS SUBROUTINE CONVERTS A 3 DIGIT BCD NUMBER TO BINARY
01222                   ;
01223                   ;ENTRY:   <A>=MSD   A = BCD1    C = BCD2,BCD3
01224                   ;         <C>=LSD
01225                   ;
01226                   ;
01227                   ;EXIT:    <HL>=BINARY NUMBER
01228                   ;
01229                   ;
01230                   ;
01231 02AF 210000       BCDBIN  LD   HL,00H
01232 02B2 CDC502  >            CALL TIMES10
01233 02B5 79                   LD   A,C
01234 02B6 1F                   RRA
01235 02B7 1F                   RRA
01236 02B8 1F                   RRA
01237 02B9 1F                   RRA
01238 02BA CDC502  >            CALL TIMES10
01239 02BD 79                   LD   A,C
01240 02BE E60F                 AND  0FH
01241 02C0 5F                   LD   E,A
01242 02C1 1600                 LD   D,00H
01243 02C3 19                   ADD  HL,DE
01244 02C4 C9                   RET
01245 02C5 E60F         TIMES10 AND  0FH
01246 02C7 85                   ADD  A,L
01247 02C8 6F                   LD   L,A
01248 02C9 29                   ADD  HL,HL
01249 02CA 54                   LD   D,H
01250 02CB 5D                   LD   E,L
01251 02CC 29                   ADD  HL,HL
01252 02CD 29                   ADD  HL,HL
01253 02CE 19                   ADD  HL,DE
01254 02CF C9                   RET
01257
01258
01259                   ;       COPIER JAM TASK
01260                   ;
01261                   ;THIS TASK CALLS THE JAM SUBROUTINE
01262                   ;
01263
01264
01265
01266 02D0 FDCB02EE     CJAM    SET  COLOFF,(IY+ESTAT)         ;SET THE TASK RUNNING FLAG
01267 02D4 110020               LD   DE,TURNOFF
01268 02D7 DF                   RST  TSET
```

```
01269 02D8 FDCB026E   CJAM1    BIT  COLOFF,(IY+ESTAT)
01270 02DC 2807                JR   Z,CJAM2
01271 02DE E7                  RST  TTIME
01272 02DF 38F7                JR   C,CJAM1
01273
01274 02E1 F3                  DI
01275 02E2 CD0604  >           CALL ALLOFF
01276 02E5 C3C300  >   CJAM2   JP   TRMCT
01277
01278
01279
01280
01281
01282
01283                  ;       JAM SUBROUTINE
01284
01285                  ;NOTE: THIS USED TO BE A TASK BUT IT IS NOW A SUBROUTINE.
01286
01287                  ;
01288                  ;THIS TASK STOPS THE RUN TASK
01289                  ;WHEN IT HAS DETECTED A RESET IT STARTS THE RUN TASK AGAIN AND TERMINATES.
01290                  ;
01291
01292
01293 02EB FDCB00FE   JAMRES   SET  JAMSTOP,(IY+JSTAT)      ;SET THE STOP FLAG AND WAIT FOR A RESET.
01294
01295                  ;?????
01296 02EC FDCB007E   JAMRES1  BIT  JAMSTOP,(IY+JSTAT)      ;CHECK TO SEE IF THE COPIER HAS RESET THE FLAG.
01297 02F0 280B                JR   Z,JAMRES2
01298 02F2 CDDE03  >           CALL SENSOR
01299 02F5 CB5F                BIT  JMRST,A
01300 02F7 20F3                JR   NZ,JAMRES1
01301 02F9 FDCB00BE            RES  JAMSTOP,(IY+JSTAT)      ;RESET THE STOP FLAG
01302 02FD 3EB0       JAMRES2  LD   A,JCLEAR                ;SEND JAM CLEAR CODE.
01303 02FF C35807  >           JP   PRIOUT                  ;EXIT THRU OUTPUT
01304
01305
01306
01307
01308
01309                  ;******** THIS NEEDS A LOT OF WORK **********
01310
01311
01312
01313 0302 21011B     UNFREZE  LD   HL,PORT1
01314 0305 FDCB0046            BIT  PROOFF,(IY+JSTAT)       ;IF THIS IS PROOF MODE THE TURN ON THE
01315 0309 2804                JR   Z,UNFREZE0              ;PROOF FINGERS.
01316 030B 3E03                LD   A,PRFC
01317 030D 77                  LD   (HL),A
01318 030E C9                  RET
01319
01320 030F FD4604     UNFREZE0 LD   B,(IY+SAVE)             ;B=ACTIVE COLLATOR
01321 0312 2B                  DEC  HL
01322
01323 0313 23         UNFREZE1 INC  HL
01324 0314 3641                LD   (HL),DIVC               ;TURN ON DIVERTERS ON THE INACTIVE COLLATORS
01325                  ;DELAY ??????
01326 0316 10FB                DJNZ UNFREZE1
01327 0318 3601                LD   (HL),DVMC               ;TURN ON THE ACTIVE COLLATOR
01328 031A C9                  RET
01329
01330
01331
01332 031B 3A0518     INTCHK   LD   A,(RBIN1)
01333 031E E6F0                AND  0F0H
01334 0320 FDBE06              CP   (IY+CONFIG)
01335 0323 C9                  RET
01336
01337
01338
01339 0324 CF         IJAM     RST  DISMISS                 ;SYNCRONIZE WITH JAMTSK.
01340 0325 CD1B03  >           CALL INTCHK
01341 0328 28FA                JR   Z,IJAM
01342 032A CD0604  >           CALL ALLOFF
01343 032D FDCB0246            BIT  JAMFLAG,(IY+ESTAT)      ;IF WE ARE PROCESSING A JAM THEN ERROR:=FALSE
01344 0331 20F1                JR   NZ,IJAM
01345
01346 0333 FDCB02CE            SET  INTLOK,(IY+ESTAT)
01347 0337 3EF0                LD   A,INTLK
01348 0339 CD5807  >           CALL PRIOUT
01349
01350 033C CD1B03  >   IJAM1   CALL INTCHK                  ;WAIT FOR THE DOOR TO CLOSE.
01351 033F 20FB                JR   NZ,IJAM1
01352 0341 CDFF03  >           CALL SLOWDOWN                ;DEBOUNCE THE INTERLOCK SWITCH.
01353 0344 FDCB028E            RES  INTLOK,(IY+ESTAT)
01354 0348 CD4507  >           CALL SORTRDY
01355 034B 18D7                JR   IJAM
01356
01357
01358
01359 034D FDCB0246   JAMTSK   BIT  JAMFLAG,(IY+ESTAT)      ;IF A JAM IS IN PROGRESS THEN
01360 0351 202C                JR   NZ,JAMTSK3              ;DO NOT ACCEPT ANY MORE JAMS.
01361 0353 FDCB02C6            SET  JAMFLAG,(IY+ESTAT)
01362 0357 CD0604  >           CALL ALLOFF
01363 035A CD5807  >           CALL PRIOUT
01364 035D 21011B              LD   HL,PORT1
01365 0360 3603                LD   (HL),PRFC               ;TURN ON THE PROOF FINGERS
01366 0362 CDE201  >           CALL COPJAM
01367 0365 CDEB02  >   JAMTSK0 CALL JAMRES                  ;THE JAM CLEAR CODE IS SENT BY THIS SUBROUTINE
01368
01369 036B CDDE03  >   JAMTSK1 CALL SENSOR
01370 036B CB47                BIT  PSDP,A
01371 036D 28F9                JR   Z,JAMTSK1
01372 036F CB7F                BIT  ENTRY,A
01373 0371 28F5                JR   Z,JAMTSK1
01374
01375 0373 CD1B03  >   JAMTSK2 CALL INTCHK
01376 0376 20FB                JR   NZ,JAMTSK2
01377
```

```
01378 0378 FDCB0286            RES  JAMFLAG,(IY+ESTAT)
01379 037C CD4507  >           CALL SORTRDY
01380
01381
01382
01383 037F FDCB0246   JAMTSK3  BIT  JAMFLAG,(IY+ESTAT)
01384 0383 CF                  RST  DISMISS
01385 0384 20F9                JR   NZ,JAMTSK3              ;HOLD HERE UNTIL THE JAM HAS BEEN PROCESSED.
01386
01387
01388 0386 FDCB01B6   TURNONO  RES  STARTF,(IY+JBUF)
01389
01390
01391
01392 038A FDCB0176   TURNON   BIT  STARTF,(IY+JBUF)
01393 038E 2013                JR   NZ,JAMTSK4
01394
01395 0390 FDCB015E            BIT  JAMMAN,(IY+JBUF)
01396 0394 2006                JR   NZ,TRNON1
01397 0396 FDCB027E            BIT  MANMOD,(IY+ESTAT)
01398 039A 28EE                JR   Z,TURNON
01399
01400 039C 3A0518     TRNON1   LD   A,(RBIN1)
01401 039F CB5F                BIT  MANINS,A
01402 03A1 20E7                JR   NZ,TURNON
01403 03A3 C3D301  >  JAMTSK4  JP   START5                  ;TURN ON THE COLLATORS AND RESET THE ERROR COUNT
01404                 ;WATCH THE REGISTERS!!!  WE MUST RETURN WITH  HL INTACT
01405
01406
01407
01408
01409                 ;JAMDET   LD   A,(COPCT)
01410
01411                 ;         CP   THRES                 ;IF COPCT>THRES THEN JAM ERROR:=TRUE
01412                 ;         RET
01413
01414
01415
01416
01417
01418                 ;         ENABLE MODE CHANGE TASK
01419                 ;
01420                 ;
01421                 ;THIS TASK SATISFIES THE FOLLOWING SPECIFICATION.
01422                 ;
01423                 ;IF NEWMODE$=SORT OR NEWMODE$=COLLATE AND PAPER IN BIN$=TRUE THEN SEND #BIN COPY CODE#
01424                 ; ELSE IF PAPER IN BIN=FALSE THEN SEND #SORTER READY CODE#
01425                 ;IF NEWMODE$=OLDMODE$ THEN SEND #SORTER READY CODE#
01426                 ;REPETE UNTIL CONDITION IS MET.
01427                 ;
01428                 ;
01429 03A6 FDCB02D6   ALLOW    SET  ALENB,(IY+ESTAT)
01430 03AA 3EA0                LD   A,PINB                ;SEND BIN COPY CODE
01431 03AC CD4F07  >           CALL OUTPUT
01432 03AF 3A0B10  >  ALLOW1   LD   A,(IYJBUF)
01433 03B2 E607                AND  07H
01434 03B4 CB47                BIT  PROOFF,A
01435 03B6 2011                JR   NZ,ALLOW2            ;IF NEWMODE$=PROOF MODE$ THEN END
01436 03B8 4F                  LD   C,A
01437 03B9 3A0A10  >           LD   A,(IYJSTAT)
01438 03BC E607                AND  07H
01439 03BE B9                  CP   C                     ;IF     NEWMODE$=OLDMODE$ THEN END
01440 03BF 280B                JR Z,ALLOW2
01441 03C1 CDDE03  >           CALL SENSOR
01442                 ;        BIT  PBIN,A                ;IF PAPER IN BIN$=FALSE THEN END
01443 03C4 2003                JR   NZ,ALLOW2
01444 03C6 CF                  RST DISMISS
01445 03C7 18E6                JR   ALLOW1           ;ELSE REPETE
01446 03C9 FDCB0296   ALLOW2   RES  ALENB,(IY+ESTAT)
01447 03CD CD4507  >           CALL SORTRDY
01448
01449 03D0 2A1E10  >           LD   HL,(NUMBUF)
01450 03D3 CD7A02  >           CALL CONDIG                ;MAKE SURE THE NUMBER IS NOT TO BIG
01451 03D6 F3                  DI
01452 03D7 FDCB01BE            RES  ALLOWT,(IY+JBUF )     ;CLEAR THE TASK ACTIVE FLAG
01453 03DB C3C300  >           JP   TRMCT
01454
01455
01456
01457
01458
01459                 ;       READ BIN SENSOR--SUBROUTINE
01460                 ;
01461                 ;THIS SUBROUTINE  DOES A LOGICAL OR OF THE BIN SENSORS AND RETURNS THE RESULT
01462                 ; IN THE A REGISTER.
01463                 ;
01464                 ;
01465 03DE C5         SENSOR   PUSH BC
01466 03DF D5                  PUSH DE
01467 03E0 E5                  PUSH HL
01468 03E1 0603                LD   B,NBINS               ;SENSOR LOOP=3    ONLY 3 BINS ARE IN THE CIRCUIT
01469 03E3 21011B              LD   HL,PORT1              ;POINTER TO FIRST SENSOR
01470 03E6 0EFF                LD   C,0FFH
01471 03E8 FD5606              LD   D,(IY+CONFIG)
01472 03EB CB02                RLC  D
01473 03ED 7E         SENSOR1  LD   A,(HL)
01474 03EE EE03                XOR  CMPL                  ;COMPLEMENT WHAT EVER YOU HAVE TO.
01475 03F0 A1                  AND  C
01476 03F1 CB02                RLC  D
01477 03F3 3804                JR   C,SENSOR2             ;OUTPUTS  LOW>=TRUE
01478 03F5 4F                  LD   C,A
01479 03F6 23                  INC  HL
01480 03F7 10F4                DJNZ SENSOR1
01481 03F9 E1         SENSOR2  POP  HL
01482 03FA D1                  POP  DE
01483 03FB C1                  POP  BC
01484 03FC CB4F                BIT  PBIN,A
01485 03FE C9                  RET
01486
```

```
01487
01488
01489
01490
01491 03FF D5          SLOWDOWN PUSH DE                    ;THIS TASK CAUSES A SHORT DELAY WHILE EVERYTHING CATCHES UP
01492 0400 112000               LD   DE,WAIT10
01493 0403 D7                   RST  WAIT
01494 0404 D1                   POP  DE
01495 0405 C9                   RET
01496
01497
01498
01499
01500
01501 0406 E5          ALLOFF   PUSH HL                     ;???? DO WE NEED TO SAVE THE HL ?????
01502 0407 210000               LD   HL,0000H
01503 040A 220118               LD   (PORT1),HL              ;LOAD THE PORTS WITH ZEROS  TO TURN OFF EVERYTHING.
01504 040D 220218               LD   (PORT2),HL
01505 0410 E1                   POP  HL
01506 0411 FDCB02AE             RES  COLOFF,(IY+ESTAT)
01507 0415 C9                   RET
01510
01511
01512
01513                  ;NOTE: THE COLLATOR IS TURNED ON BY THE START ROUTINE.
01514 0416 CDDE03  >   RUN1     CALL SENSOR                  ;IF      PAPER IN BIN$=FALSE THEN RESET THE BINS
01515                  ;        BIT  PBIN,A
01516 0419 F5                   PUSH AF
01517 041A C41205  >            CALL NZ,RESBIN
01518 041D F1                   POP  AF
01519 041E CCF304  >            CALL Z,INDEX
01520 0421 AF          RUN2     XOR  A
01521 0422 321310  >            LD   (SHEETCNT),A
01522
01523 0425 CDA604  >   RUN3     CALL PAPER
01524 0428 2810                 JR   Z,RUN6B                 ;IF      JOBCNT$=0 THEN END
01525
01526 042A 3A1310  >            LD   A,(SHEETCNT)
01527 042D 3C                   INC  A
01528 042E 321310  >            LD   (SHEETCNT),A
01529 0431 FE32                 CP   SPKTSZ                  ;COMPARE TO SORT MODE POCKET SIZE
01530 0433 20F0        RUN4     JR   NZ,RUN3                 ;IF      POCKET NOT FULL THE CONTINUE
01531 0435 CDF304  >            CALL INDEX
01532 0438 18E7                 JR   RUN2                    ;GOTO INDEX
01533
01534
01535                  ;RUN6     CALL INDEX                  ;ADVANCE THE SLIDER FOR THE NEXT JOB.
01536 043A FDCB027E    RUN6B    BIT  MANMOD,(IY+ESTAT)       ;IF THIS WAS MANUAL MODE THEN DO NOT
01537 043E 2005                 JR   NZ,RUN6A                ;SEND THE END CODE.
01538 0440 3E12                 LD   A,CYCEND
01539 0442 CD4F07  >            CALL OUTPUT                  ;TELL COPIER THAT WE ARE DONE
01540 0445 FDCB01B6    RUN6A    RES  STARTF,(IY+JBUF )       ;TURN OFF THE START FLAG
01541 0449 FDCB02BE             RES  MANMOD,(IY+ESTAT)
01542 044D CD0604  >   RUN      CALL ALLOFF                  ;THIS IS THE ENTRANCE
01543
01544
01545 0450 CF          RUN7     RST  DISMISS
01546 0451 FDCB0146             BIT  PROOFF,(IY+JBUF)
01547 0455 20F9                 JR   NZ,RUN7
01548 0457 FDCB0176             BIT  STARTF,(IY+JBUF )
01549 045B 2019                 JR  NZ,RUN7A                 ;THERE IS NOTHING TO DO.
01550
01551
01552 045D 3A0C10  >   MANB     LD   A,(IYESTAT)             ;LOOK FOR ERRORS
01553 0460 E61F                 AND  MANMSK
01554 0462 20EC                 JR   NZ,RUN7
01555
01556
01557 0464 3A0518               LD   A,(RBIN1)
01558 0467 CB5F                 BIT  MANINS,A                ;DO THEY WANT TO DO A MANUAL INSERTION?
01559 0469 20E5                 JR   NZ,RUN7
01560 046B CDB401  >            CALL START2          ;SET UP THE MODE  FOR MANUAL INSERTION.
01561 046E FDCB01E6             SET  MODCHG,(IY+JBUF)        ;DO A RESTART TO ESCAPE FROM MANUAL MODE
01562 0472 FDCB02FE             SET  MANMOD,(IY+ESTAT)       ;SET THE MANUAL MODE FLAG.
01563
01564
01565
01566                  ;*** NOTE: THE BINS ARE TURNED ON BY THE START ROUTINE IN OPER.
01567 0476 ED5B1C10>   RUN7A    LD   DE,(BUFCNT)
01568 047A ED531610>            LD   (JOBCNT),DE
01569
01570 047E FDCB004E             BIT  SORTF,(IY+JSTAT)
01571 0482 2092                 JR   NZ,RUN1                 ;SORT MODE
01572 0484 CDDE03  >            CALL SENSOR
01573                  ;        BIT  PBIN,A                  ;IF      THERE IS NO PAPER THEN RESET THE COLCNT.
01574 0487 2804                 JR   Z,RUN8
01575 0489 AF                   XOR  A                       ;SHEETCNT:=0
01576 048A 321310  >            LD   (SHEETCNT),A
01577 048D CD1205  >   RUN8     CALL RESBIN                  ;COLLATE MODE  START BY RESETING THE BINS.
01578
01579 0490 3A1310  >            LD   A,(SHEETCNT)
01580 0493 3C                   INC  A
01581 0494 321310  >            LD   (SHEETCNT),A
01582 0497 FE65                 CP   PKTSZ+1                 ;COLLATE MODE POCKET SIZE.
01583 0499 CC0D05  >            CALL Z,INDEX3
01584
01585 049C CDA604  >   RUN9     CALL PAPER
01586 049F 2899                 JR   Z,RUN6B
01587 04A1 CDF304  >            CALL INDEX
01588 04A4 18F6                 JR   RUN9
01589
01590
01591
01592
01593                  ;PAPER    BIT  STARTF,(IY+JBUF )
01594                  ;        JR   NZ,PAPER0
01595
01596
01597                  ;PAPER0   CALL JAMDET
```

```
01598                   ;         JP   P,PAPER2
01599
01600
01601
01602                   ;PAPER     BIT  TRANSFLG,(IY+ESTAT)
01603                   ;         JR   Z,PAPER
01604                   ;         RES  TRANSFLG,(IY+ESTAT)
01605
01606
01607 04A6 3A1210  >    PAPER     LD   A,(TRANSCNT)
01608 04A9 A7                     AND  A
01609 04AA 28FA                   JR   Z,PAPER
01610
01611 04AC 3D                     DEC  A
01612 04AD 321210  >              LD   (TRANSCNT),A
01613
01614 04B0 110030                 LD   DE,TRANSTIM              ;WORST CASE TRANSIT TIME.
01615 04B3 DF                     RST  TSET
01616
01617 04B4 E7           PAPER0    RST  TTIME
01618 04B5 300F                   JR   NC,PAPER1A
01619 04B7 CB46                   BIT  PSDP,(HL)
01620 04B9 28F9                   JR   Z,PAPER0                 ;PAPER HAS BEEN DETECTED.
01621
01622 04BB 115002                 LD   DE,JAMCNT
01623 04BE DF                     RST  TSET
01624 04BF CB46         PAPER1    BIT  PSDP,(HL)
01625 04C1 2817                   JR   Z,PAPER4
01626 04C3 E7                     RST  TTIME
01627 04C4 38F9                   JR   C,PAPER1
01628 04C6 CDCB04  >    PAPER1A   CALL PAPER3
01629 04C9 18DB                   JR   PAPER
01630
01631
01632                   ;PAPER3    BIT  INTF,(IY+JSTAT)          ;IF WE ARE IN INTUERRUPT MODE THEN WE
01633                   ;         JR   NZ,PAPER3                ;HAVE TO WAIT FOR THE THE COPIER TO FINISH
01634                   ;                                        BEFORE WE DO THE JAM RECOVERY.
01635
01636
01637 04CB FDCB027E     PAPER3    BIT  MANMOD,(IY+ESTAT)        ;IF THIS IS MANUAL MODE THEN DO NOT SET
01638 04CF 2004                   JR   NZ,PAPER3A               ;THE JAMMAN FLAG
01639 04D1 FDCB01DE               SET  JAMMAN,(IY+JBUF )        ;SET THE JAM MODE MANUAL INSERTION ENABLE FLAG
01640 04D5 3EE0         PAPER3A   LD   A,JAM2                   ;JAM TYPE 2
01641 04D7 C34D03  >              JP   JAMTSK
01642
01643
01644 04DA 3E02         PAPER4    LD   A,FPD
01645 04DC FDCB027E               BIT  MANMOD,(IY+ESTAT)        ;IF THIS IS MANUAL MODE THEN SEND A SRDY
01646 04E0 2B02                   JR   Z,PAPER5
01647
01648 04E2 3E10                   LD   A,SRDY                   ;ELSE THIS IS MANUAL MODE AND  OUTPUT:=SORTER READY
01649
01650 04E4 CD4F07  >    PAPER5    CALL OUTPUT
01651
01652
01653                   ;         LD   A,(COPCT)
01654                   ;         DEC  A
01655                   ;         LD   (COPCT),A
01656
01657
01658 04E7 ED5B1610>              LD   DE,(JOBCNT)
01659 04EB 1B                     DEC  DE
01660 04EC ED531610>              LD   (JOBCNT),DE
01661 04F0 7A                     LD   A,D
01662 04F1 B3                     OR   E
01663 04F2 C9                     RET
01664
01665
01666
01667 04F3 CB66         INDEX     BIT  SLSTOP,(HL)              ;EXIT THRU THE INDEX ROUTINE
01668 04F5 C22105  >              JP   NZ,SLIDEX
01669                   ;FALL THRU TO INDEX1
01670
01671 04F8 3A1010  >    INDEX1    LD   A,(CONFIGU)              ;LOOK AT THE NEXT BIN AND SEE IF IT IS ATTACHED.
01672 04FB 07           INDEX2    RLCA
01673 04FC 10FD                   DJNZ INDEX2                   ;IF THIS IS THE LAST BIN THEN OVFL ERROR
01674 04FE 380D                   JR   C,INDEX3
01675
01676 0500 CD3E05  >              CALL SETHOME                  ;SEND THE OLD BIN HOME.
01677 0503 2C                     INC  L
01678 0504 CD5505  >              CALL GOHOME                   ;MAKE SURE THE NEW BIN IS HOME
01679
01680 0507 FD7504       INDEX2A   LD   (IY+SAVE),L              ;SAVE THE BIN NUMBER FOR  UNFREZE
01681 050A C30203  >              JP   UNFREZE                  ;EXIT THRU UNFREZE  TO TURN EVERYTHING ON
01682
01683
01684
01685                   ;THIS IS A BIG QUESTION MARK  LETS TRY IT THIS WAY AND SEE IF IT WORKS
01686 050D 3EC0         INDEX3    LD   A,OVFL
01687 050F CD4D03  >              CALL JAMTSK
01688
01689
01690                   ;         CALL OUTPUT
01691                   ;DO SOMETHING HERE TO COUNT THE SHEETS THAT WE ARE SENT.
01692                   ;         CALL COPJAM
01693                   ;INDEX4    CALL SENSOR
01694                   ;         JR   Z,INDEX4                 ;WAIT FOR THE PAPER TO BE REMOVED
01695                   ;;        RES  JAMSTOP,(IY+JSTAT)
01696                   ;         CALL SORTRDY
01697                   ;
01698                   ;         BIT  COLLF,(IY+JSTAT)
01699                   ;         RET  NZ                       ;IF THIS IS COLLATE MODE THEN DO NOT RESET BINS
01700                   ;         CALL TURNONO                  ;WAIT FOR THE START BUTTON TO BE PUSHED
01701                   ;FALL INTO RESBIN
01702
01703
01704
```

```
01705 0512 FDCB01EE   RESBIN   SET  ALLBINS,(IY+JBUF)
01706 0516 CD5505  >           CALL GOHOME
01707 0519 CD0604  >           CALL ALLOFF
01708 051C 21011B              LD   HL,PORT1                  ;POINTER:=BIN1
01709 051F 18E6                JR   INDEX2A
01711
01712
01713
01714 0521 FDCB00EE   SLIDEX   SET  ODIS,(IY+JSTAT)           ;DISABLE THE OUTPUT SO IT WONT HANG US UP
01715 0525 CB66                BIT  SLSTOP,(HL)   ;THIS TEST IS TO BE REMOVED IT IS ONLY A SAFETY DURING TESTING.
01716 0527 280E                JR   Z,SLID10
01717 0529 3611       SLID8    LD   (HL),DNDV                 ;BIN(HL) GOING DOWN
01718 052B CB6E                BIT  VANE,(HL)               ;ELSE LOOK FOR THE GAP
01719 052D 20F2                JR   NZ,SLIDEX
01720
01721 052F CB66       SLID9    BIT  SLSTOP,(HL)
01722 0531 2804                JR   Z,SLID10
01723 0533 CB6E                BIT  VANE,(HL)               ;IF GAP$=TRUE THEN LOOK FOR THE VANE
01724                 ;***** NOTE: WE ARE BETTING ON INERTIA TO GET US OUT OF HERE
01725                 ;            IF SOMEONE KILL THE POWER.  *** THIS MAY NOT BE A SAFE BET.
01726 0535 28FB                JR   Z,SLID9
01727 0537 3601       SLID10   LD   (HL),DVMC
01728 0539 FDCB00AE            RES  ODIS,(IY+JSTAT)
01729 053D C9                  RET
01730
01731                 ;WE DO NOT SAVE THE <DE> BUT WE DO SAVE THE <HL>
01732 053E 11C010     SETHOME  LD   DE,SPALLOW               ;IF YOU TRY TO CHANGE MODE WHILE WE ARE USEING
01733 0541 E5                  PUSH HL                        ;THIS STACK WE WILL BE BLOWEN AWAY!!!!!
01734 0542 E5                  PUSH HL
01735 0543 C1                  POP  BC                        ;PASS THE BIN NUMBER TO THE HOME TASK.
01736 0544 214C05  >           LD   HL,HOMETSK
01737 0547 CD9000  >           CALL INITNT
01738 054A E1                  POP  HL                        ;RESTORE THE HL
01739 054B C9                  RET
01740
01741
01742
01743 054C DDE5       HOMETSK  PUSH IX
01744 054E E1                  POP  HL
01745 054F CD5505  >           CALL GOHOME
01746 0552 C3C300  >           JP   TRMCT
01747
01748
01749
01750 0555 FDCB016E   GOHOME   BIT  ALLBINS,(IY+JBUF)         ;DO WE SEND ALL THE BINS HOME?
01751 0559 CA7205  >           JP   Z,HTSK4
01752
01753 055C 3A1010  >  HTSK1    LD   A,(CONFIGU)
01754 055F 0603                LD   B,NBINS
01755 0561 21011B              LD   HL,PORT1
01756 0564 17         HTSK2    RLA
01757 0565 D47205  >           CALL NC,HTSK4
01758 0568 23                  INC  HL
01759 0569 10F9                DJNZ HTSK2
01760 056B FDCB01AE            RES  ALLBINS,(IY+JBUF)
01761 056F C9                  RET
01762
01763
01764 0570 3661       HTSK3    LD (HL),UPDIV                  ;BIN(HL) GOING UP  WITH DIVERTER ON.
01765 0572 CB56       HTSK4    BIT  HOME,(HL)
01766 0574 20FA                JR   NZ,HTSK3
01767 0576 3641                LD   (HL),DIVC                 ;MOTOR AND DIVERTER ON
01768
01769 0578 C9                  RET
01770
01771
01772                 ;**** THE DIVERTER IS BEING TURNED ON SO THAT GOING HOME WILL NOT
01773                 ;      INTERFERE WITH THE RUN TASK
01776 0579 CD0604  >  PRFTSKO  CALL ALLOFF
01777 057C 110030     PRFTSK   LD   DE,MANTIME
01778 057F DF                  RST  TSET
01779
01780 0580 FDCB015E   PRFTSK1  BIT  JAMMAN,(IY+JBUF)
01781 0584 C22806  >           JP   NZ,MANUAL
01782 0587 FDCB027E            BIT  MANMOD,(IY+ESTAT)
01783 058B C22806  >           JP   NZ,MANUAL
01784
01785 058E FDCB0176            BIT  STARTF,(IY+JBUF )
01786 0592 CA7606  >           JP   Z,MINDEX
01787 0595 FDCB0046            BIT  PROOFF,(IY+JSTAT)
01788                 ;        JP   NZ,PRFRUN
01789
01790 0599 CAAD05  >           JP   Z,ENTRYJAM
01791
01792
01793                 ;**** NOTE: THE BIN IS TURNED ON BY THE START ROUTINE IN OPER.
01794
01795
01796 059C FDCB0276   PRFRUN   BIT  NEWJOB,(IY+ESTAT)         ;IF THIS IS A NEW JOB THEN LOAD THE JOBCNT
01797 05A0 CAAD05  >           JP   Z,ENTRYJAM
01798 05A3 2A1C10  >           LD   HL,(BUFCNT)
01799 05A6 221610  >           LD   (JOBCNT),HL
01800 05A9 FDCB02B6            RES  NEWJOB,(IY+ESTAT)
01801
01802
01803
01804                 ;ENTRY JAM DETECTION***
01805
01806                 ;ENTRYJAM BIT  ESEN,(IY+JSTAT)          ;WAIT FOR COPIER
01807                 ;        JP   Z,PRFTSK
01808                 ;        RES  ESEN,(IY+JSTAT)
01809
01810 05AD 3A1110  >  ENTRYJAM LD   A,(COPCT)
01811 05B0 A7                  AND  A
01812 05B1 CA7C05  >           JP   Z,PRFTSK
01813
01814 05B4 F3                  DI
01815 05B5 3A1110  >           LD   A,(COPCT)
01816 05B8 3D                  DEC  A
```

```
05B9 321110  >          LD   (COPCT),A
05BC FB                 EI

05BD 21011B             LD   HL,PORT1
05C0 110010             LD   DE,ENTJAM              ;COPIER 0A JAM COUNT
05C3 FDCB0066           BIT  COPB,(IY+JSTAT)
05C7 CACD05  >          JP   Z,EJAM0
05CA 110010             LD   DE,BENTJAM             ;COPIER 0B JAM COUNT
05CD DF          EJAM0  RST TSET

05CE CB7E        EJAM   BIT  ENTRY,(HL)             ;LOOK FOR PAPER
05D0 CAEB05  >          JP   Z,EJAM1                ;WE HAVE FOUND THE PAPER LETS CHECK FOR AN ENTRY JAM
05D3 E7                 RST  TTIME
05D4 DACE05  >          JP   C,EJAM

05D7 3E80        EJAM1A LD   A,JAM1                 ;WE RAN OUT OF TIME SO IT MUST BE A JAM
05D9 FDCB0046           BIT  PROOFF,(IY+JSTAT)     ;IF PROOF MODE THEN JAMMAN:=FALSE
05DD F5                 PUSH AF
05DE CCCB04  >          CALL Z,PAPER3
05E1 F1                 POP  AF
05E2 C44D03  >          CALL NZ,JAMTSK             ;ELSE JAMMAN:=TRUE
05E5 C37C05  >          JP   PRFTSK

05EB CDFF03  >   EJAM1  CALL SLOWDOWN              ;SWITCH DEBOUNCE.
05EB 110004             LD   DE,PRFCNT
05EE DF                 RST  TSET
05EF CB7E        EJAM1B BIT  ENTRY,(HL)
05F1 C2FB05  >          JP   NZ,EJAM2

05F4 E7                 RST  TTIME
05F5 DAEF05  >          JP   C,EJAM1B
05F8 C3D705  >          JP   EJAM1A

05FB FDCB0046    EJAM2  BIT  PROOFF,(IY+JSTAT)
05FF CA1C06  >          JP   Z,EJAM3

0602 CDDA04  >          CALL PAPER4
0605 C27C05  >          JP   NZ,PRFTSK
0608 3E12               LD   A,CYCEND
060A CD4F07  >          CALL OUTPUT
060D 110005             LD   DE,PWRDN
0610 D7                 RST  WAIT                  ;GIVE THE LAST SHEET TIME TO GET INTO THE TRAY.

0611 FDCB01B6           RES  STARTF,(IY+JBUF)
0615 FDCB02F6           SET  NEWJOB,(IY+ESTAT)
0619 C37905  >          JP   PRFTSK0

061C F3          EJAM3  DI
061D 3A1210  >          LD   A,(TRANSCNT)
0620 3C                 INC  A
0621 321210  >          LD   (TRANSCNT),A
0624 FB                 EI
0625 C37C05  >          JP   PRFTSK

                                                   ;WAIT FOR A MANUAL INSERTION.
0628 E7          MANUAL RST  TTIME                 ;IF WE TIME OUT THEN TURN OFF THE MOTORS
0629 D27905  >          JP   NC,PRFTSK0
062C CD7006  >          CALL TSTMAN
062F C28005  >          JP   NZ,PRFTSK1
                                                   ;DEBOUNCE THE INSERTION
0632 115002             LD   DE,MANHOLD
0635 DF                 RST  TSET
0636 CD7006  >   MANA   CALL TSTMAN
0639 C27C05  >          JP   NZ,PRFTSK
063C E7                 RST  TTIME
063D DA3606  >          JP   C,MANA
                                                   ;IF THIS IS MANUAL MODE THEN OUTPUT:=MANUAL INSERTION
0640 FDCB015E           BIT  JAMMAN,(IY+JBUF)      ;ELSE NO OUTPUT
0644 C26106  >          JP   NZ,MANUAL1
0647 3E90               LD   A,MANI
0649 CD4F07  >          CALL OUTPUT

                                                   ;WAIT FOR THE SLIDER TO GO HOME.
064C FDCB016E    MANC   BIT  ALLBINS,(IY+JBUF)
0650 20FA               JR   NZ,MANC

                                                   ;IF THIS IS BIN1 THEN OPEN THE GATE AND TURN ON THE MOTOR
0652 3A0E10  >   MANON  LD   A,(IYSAVE)            ;ELSE TURN ON THE GATE AND THE DIVERTER AND TURN ON THE MOTOR
0655 FE01               CP   01H
0657 3E09               LD   A,IGATE
0659 CA5E06  >          JP   Z,MANO
065C 3E49               LD   A,IGATEDIV            ;TURN ON BIN 1 AND OPEN THE GATE.
065E 32011B      MANO   LD   (PORT1),A

0661 CD7006  >   MANUAL1 CALL TSTMAN
0664 28EC               JR   Z,MANON
                                                   ;TIME DELAY FOR GETTING IN THE PAPER
0666 119000             LD   DE,MANCNT
0669 D7                 RST  WAIT
066A CD0203  >          CALL UNFREZE
066D C31C06  >          JP   EJAM3

0670 3A0518      TSTMAN LD   A,(RBIN1)
```

```
0673 CB5F                BIT  MANINS,A
0675 C9                  RET
0676 FDCB0146 MINDEX     BIT  PROOFF,(IY+JBUF )
                ;WE MUST BE IN PROOF MODE AND NOT RUNNING TO DO A MANUAL INDEX.
067A CA7C05  >           JP   Z,PRFTSK
067D CDDE03  >           CALL SENSOR
0680 CB77                BIT  MANINX,A
0682 C27C05  >           JP   NZ,PRFTSK
0685 CD0604  >           CALL ALLOFF
068B 0603     MINO       LD   B,NBINS
068A 210118              LD   HL,PORT1
068D CD1B03  >MINDEX0    CALL INTCHK                    ;IF THE INTERLOCK IS PULLED THEN EXIT
0690 C27C05  >           JP   NZ,PRFTSK
0693 CB76                BIT  MANINX,(HL)
0695 C2A606  >           JP   NZ,MINDEX2
0698 CB66                BIT  SLSTOP,(HL)
069A C2A306  >           JP   NZ,MINDEX1
069D CD5505  >           CALL GOHOME
06A0 C3A606  >           JP   MINDEX2
06A3 CD2105  >MINDEX1    CALL SLIDEX                    ;INDEX
06A6 23       MINDEX2    INC  HL
06A7 10E4                DJNZ MINDEX0
06A9 110005              LD   DE,IMIN                   ;INTERVAL DELAY
06AC D7                  RST  WAIT
06AD 110030              LD   DE,TMIN                   ;TIME OUT IF A SWITCH IS NOT PRESSED
06B0 DF                  RST  TSET
06B1 CDDE03  >MINDEX3    CALL SENSOR
06B4 CB77                BIT  MANINX,A
06B6 CA8806  >           JP   Z,MINO
06B9 E7                  RST  TTIME
06BA DAB106  >           JP   C,MINDEX3
06BD C37905  >           JP   PRFTSK0
                ;**********WE MAY WANT TO USE A VARIABLE LENGTH DATA WORD.**********
                ;
                ;THIS SUBROUTINE WILL READ DATA FROM THE COPIER, DECODE IT,
                ; AND IF IT IS VALID IT WILL PERFORM HANDSHAKING.
                ;
                ;NOTES:IF THE DATA IS NOT VALID THE PROGRAM WILL CONTINUE TO LOOP UNTIL
                ;       IT SEES VALID DATA OR ZERO.
                ;      THE <READBUF> POINTER MUST BE INITIALIZED AT POWER UP.
                ;
                ;ENTRY: THE INTERUPTS ARE DISABLED OR THE JOB BUSY FLAG IS SET.
                ;
                ;
                ;DESTROYS   A,BC,DE,HL
                ;USES       NONE
                ;GLOBALS    PORT1,PORT2,COMTAB,NUMCOM,NUMDIG,DIGMSK,READBUF,
                ;FLAGS      STROBE,
                ;
                ;
                ;EXIT:     <A>:=0
                ;          <B>:=THE BCD DIGIT IF ANY.
                ;          <C>:=THE COMMAND VALUE.
                ;          <DE>:=PORT1 ADDRESS.
                ;          <HL>:=NEW READBUF ADDRESS
                ;          <NEW READBUF>:=<OLD READBUF-2>
                ;          <READBUF-1>:=<B>
                ;          <READBUF>:=<C>
                ;
                ;
                ;
                ;*******THIS HAS BEEN MODIFIED TO USE AN INVERTED OUTPUT PORT**********
                ;          ERIC PERRAULT  15 JANUARY 1980
                ;
                        LIST
                ;
                ;
                ;     INPUT$:=PORT1
                ;     NEW INPUT$:=PORT1
                ;     LOOP UNTIL INPUT$=NEW INPUT$
                ;
06C0 F1         READO    POP  AF
06C1 210018     READ     LD   HL,PORTC                  ;10T   CHANGE TO PORTC WHEN YOU ARE READY TO USE IT.
06C4 7E         READ2    LD   A,(HL)                    ;7T
06C5 A7                  AND  A                         ;4T
                ;
                ;     IF INPUT$=FALSE THEN EXIT
                ;
06C6 C8         READ3    RET  Z                         ;11T/5T 32T NO INPUT   APPROXIMATLY 10 uSECS TO RETURN
                ;        XOR  (HL)                      ;7T       DEBOUNCE LOOP
                ;        JR   NZ,READ2                  ;12T/7T        40T NO BOUNCE
                ;        LD   A,(HL)                    ;7T
06C7 F5                  PUSH AF
06C8 E5                  PUSH HL
06C9 211107  >           LD   HL,COMTAB                 ;10T
06CC 010E00              LD   BC,NUMCOM                 ;10T
                ;
                ;    GET COMMAND FROM TABLE
                ;   IF INPUT$=COMMAND$ THEN CONTINUE.
                ;   ELSE REPEAT UNTIL OUT OF COMMANDS
                ;
06CF EDB1                CPIR                           ;21T+ 16T*NUMCOM
                ;
                ;   IF  INPUT$=COMMAND THEN ADJUST THE COMMAND VALUE AND DO THE HANDSHAKING.
                ;   ELSE IF THE INPUT$= A DIGIT$  THEN EXTRACT THE DIGIT
                ;
06D1 EAE606  >           JP   PE,READ4                  ;12T/7T     DONE
06D4 0E04                LD   C,NUMDIG                  ;7T
06D6 E60F                AND  DIGMSK                    ;7T
```

```
02037 06D8 EDB1                 CPIR                          ;21T+ 16T*NUMDIG
02038                   ;
02039                   ;    IF THE INPUT$<> A DIGIT THEN START ALL OVER.
02040                   ;    ELSE SAVE THE DIGIT AND DO THE HANDSHAKING.
02041                   ;
02042 06DA E1                   POP  HL
02043 06DB E2C006  >            JP   PO,READO                 ;12T/7T    ERROR TRY AGAIN.
02044 06DE F1                   POP  AF
02045 06DF F5                   PUSH AF  ;SAVE IT FOR THE REAL TIME TRACE
02046 06E0 E6F0                 AND  0F0H                     ;7T        GET BCD VALUE.
02047 06E2 47                   LD   B,A                      ;4T
02048 06E3 C3EB06  >            JP   READ4A
02049 06E6 3E03         READ4   LD   A,NUMDIG-1               ;7T
02050 06EB B1                   ADD  A,C                      ;4T
02051 06E9 4F                   LD   C,A                      ;4T
02052 06EA E1                   POP  HL
02053 06EB F1           READ4A  POP  AF
02054                   ;
02055                   ;    OUTPUT:=STROBE$
02056                   ;    IF INPUT$=FALSE THEN SAVE THE DATA
02057                   ;    ELSE  REPEAT
02058                   ;
02059                   ;THIS IS A SOFTWARE REAL TIME TRACE
02060 06EC ED5B1410>            LD   DE,(RLTBUF)
02061 06F0 12                   LD   (DE),A
02062 06F1 13                   INC  DE
02063 06F2 ED531410>            LD   (RLTBUF),DE
02064
02065
02066 06F6 3EFE                 LD   A,ISTROBE                ;7T    HANDSHAKE
02067 06F8 77                   LD   (HL),A                ;??T    454T WORST CASE     111T BEST CASE
02068 06F9 7E           READ5   LD   A,(HL)                   ;7T     181.6 uSEC WORST CASE   44.4uSEC BEST CASE
02069 06FA A7                   AND  A                        ;4T    GO FOR 900uSEC CLOCK.
02070 06FB 20FC                 JR   NZ,READ5                 ;12T/7T
02071 06FD 2F                   CPL                           ;4T ****** INVERTED ZERO **********
02072 06FE 77                   LD   (HL),A                ;??T
02073                   ;
02074                   ;    SAVE THE DATA IN THE READ BUFFER$
02075                   ;    AND RETURN TO THE CALLER.
02076                   ;       DONE.
02077                   ;
02078                   ;****** USE A FIFO BUFFER
02079 06FF 2A2610  >    READ5A  LD   HL,(WRITEBUF)            ;16T
02080
02081 0702 7E                   LD   A,(HL)                   ;FOR DEVELOPMENT ONLY
02082 0703 A7                   AND  A
02083 0704 2801                 JR   Z,READ6
02084 0706 76                   HALT ;WE HAVE OVERFLOWED OUR BUFFER
02085
02086
02087 0707 71           READ6   LD   (HL),C                   ;7T
02088 0708 23                   INC  HL
02089 0709 70                   LD   (HL),B                   ;7T
02090 070A 23                   INC  HL
02091 070B CB9D                 RES  ROLLOVER,L
02092 070D 222610  >            LD   (WRITEBUF),HL            ;16T
02093 0710 C9                   RET
02094                   ;
02095                   ;
02096                   ;
02097                   ;
02098                   ;
02099                   ;DATA TABLES
02100 0711 83           COMTAB  BYTE 83H                      ;END SENSOR     ARRANGED BY EXPECTED FRENQUENCY
02101 0712 B1                   BYTE 0B1H                     ;MODE SHUT OFF
02102 0713 03                   BYTE 03H                      ;SORTER START
02103 0714 11                   BYTE 11H                      ;COPY MODE    PROOF MODE
02104 0715 31                   BYTE 31H                      ;RICOH SORT MODE  NORFIN COLLATE
02105 0716 51                   BYTE 51H                      ;RICOH COLLATE MODE  NORFIN STACK MODE
02106 0717 71                   BYTE 71H                      ;INTERRUPT MODE
02107 071B F1                   BYTE 0F1H                     ;INTERRUPT RESET
02108 0719 43                   BYTE 43H                      ;COPIER JAM
02109 071A 63                   BYTE 63H                      ;MOTOR STOP (COPIER INTERLOCK)
02110 071B 23                   BYTE 23H                      ;JAM MOTOR RESET
02111 071C D1                   BYTE 0D1H                     ;STOP  THIS ALLOWS A CHANGE OF MODE
02112 071D 91                   BYTE 91H                      ;P1 MODE THIS IS COPIER B
02113 071E 00                   BYTE 00H                      ;BC=0     DIGITS AND ERRORS GO HERE.
02114 071F 0D                   BYTE 0DH                      ;THIRD DIGIT
02115 0720 09                   BYTE 09H                      ;SECOND DIGIT
02116 0721 05                   BYTE 05H                      ;FIRST  DIGIT
02117 0722 00                   BYTE 00H                      ;BC=0    ERROR   *NOT A VALID INPUT CODE.
02118                   ;
02119                   ;
02120                   ;
02121                   ;
02122 0723 0000         CJPTAB  WORD OPTEST                   ;OPERATION TEST -CAUSES A DELAY
02123 0725 5D02    >            WORD FIRDIG                   ;FIRST DIGIT
02124 0727 5302    >            WORD SECDIG                   ;SECOND DIGIT
02125 0729 5802    >            WORD THDIG                    ;THIRD DIGIT
02126 072B 7901    >            WORD P1MOD                    ;P1 MODE
02127 072D F301    >            WORD STOP                     ;STOP  THIS IS A BAD NASTY
02128 072F F201    >            WORD JRESET                   ;JAM RESET (COPIER)
02129 0731 E201    >            WORD COPJAM                   ;JAM (COPIER)
02130 0733 E201    >            WORD COPJAM                   ;JAM (COPIER)  :THE SAME ROUTINE HANDLES BOTH.
02131 0735 3A02    >            WORD INTRPT1                  ;INTERRUPT MODE RESET
02132 0737 2702    >            WORD INTRPT                   ; INTERUPT MODE
02133 0739 0602    >            WORD SORT                     ;SORT MODE
02134 073B 0202    >            WORD COLL                     ;COLLATE MODE
02135 073D FE01    >            WORD PROOF                    ;COPY MODE
02136 073F A101    >            WORD START                    ;SORTER START
02137 0741 7E01    >            WORD MODOFF                   ;MODE SHUTOFF
02138 0743 6F01    >            WORD ENDSEN                   ;END SENSOR
```

```
02141                    ;
02142                    ;THIS SUBROUTINE IS FULLY RE-ENTRANT. IT WILL OUTPUT DATA
02143                    ;TO THE COPIER AND RETURN TO THE CALLING ROUTINE.
02144                    ;
02145                    ;NOTES:IF THE OUTPUT DISABLE FLAG IS SET THIS TASK WILL WAIT FOR IT TO
02146                    ;       BE CLEARED BEFORE IT OUTPUTS THE DATA.
02147                    ;      THE DATA WILL BE SAVED ON THE CALLERS STACK DURING INTERUPTIONS
02148                    ;       IN THE JOB FLOW.
02149                    ;      THE DATA MUST NOT HAVE THE STROBE (BIT 0) SET.
02150                    ;
02151                    ;
02152                    ;ENTRY-THE DATA TO BE OUTPUT IS IN THE <A> REGISTER.
02153                    ;      AND THE DATA TO BE OUTPUT HAS BEEN PLACED IN THE WORD OUT BUFFER.
02154                    ;
02155                    ;
02156                    ;DESTROYS  A,DE,HL
02157                    ;USES      IY,SP
02158                    ;GLOBALS   PORT1,PORT2,JSTAT,READ,DISMISS
02159                    ;FLAGS     ODIS,JBUSY,ST,STROBE
02160                    ;
02161                    ;
02162                    ;EXIT:
02163                    ;     THE CONTENTS OF THE  <A> REGISTER HAS BEEN SENT TO THE COPIER.
02164                    ;
02165                    ;
02166                    ;***********THIS HAS BEEN MODIFIED FOR USE WITH AN INVERTED OUTPUT PORT******
02167                    ;               ERIC PERRAULT   15 JANUARY 1980
02168                    ;
02169                    ;
02170                    ;
02171 0745 3A0C10  >     SORTRDY  LD   A,(IYESTAT)          ;MAKE SURE THAT EVERYONE IS READY.
02172 0748 E61F                   AND  ERRMSK
02173 074A C0                     RET  NZ
02174 074B 3E10                   LD   A,SRDY
02175 074D 1809                   JR   PRIOUT
02176 074F FDCB006E      OUTPUT   BIT  ODIS,(IY+JSTAT)      ;READ OUTPUT DISABLE$
02177 0753 2803                   JR   Z,PRIOUT            ;IF OUTPUT DISABLE$=TRUE THEN EXIT
02178 0755 CF                     RST  DISMISS
02179 0756 18F7                   JR   OUTPUT
02180 0758 F3            PRIOUT   DI   ;WE HAVE TO DISABLE THE INTERRUPTS BECAUSE OF THE
02181                    ;               STACK OVERFLOW
02182 0759 C5                     PUSH BC
02183 075A D5                     PUSH DE
02184 075B E5                     PUSH HL
02185 075C F5            OUTP3    PUSH AF                  ;SP$:=WORD OUT$
02186
02187                    ;NOT PRESENTLY REQUIRED.
02188                    ;        LD   A,0F8H
02189                    ;        LD   (IYDFLAG),A         ;SET UP A NOSWITCH CYCLE FOR APPROX 5 MILISEC
02190
02191 075D CDC106  >             CALL READ                ;IF INPUT$<>0 THEN READ THE INPUT
02192 0760 F1                    POP  AF                  ;(OUTPUT PORT):=WORD OUT$
02193
02194
02195                    ;THIS IS FOR TESTING
02196 0761 2A1410  >             LD   HL,(RLTBUF)
02197 0764 77                    LD   (HL),A
02198 0765 23                    INC  HL
02199 0766 221410  >             LD   (RLTBUF),HL
02200
02201
02202 0769 F5                    PUSH AF
02203 076A 210018                LD   HL,PORTC
                                                          ;(*HL=PORT1 AND DE=PORT2*)
02204
02205 076D 2F                    CPL                      ;****** INVERT DATA *******
02206 076E 77                    LD   (HL),A
02207                    ;******* (OR STROBE)=(AND ISTROBE) INVERT STROBE **********
02208 076F E6FE                  AND ISTROBE              ;(*DELAY THE STROBE FOR 10 MICROSECOND SETTLING TIME*)
02209 0771 77                    LD   (HL),A              ;(OUTPUT PORT):=WORD OUT$ + STROBE$
02210 0772 7E            OUTP4   LD   A,(HL)             ;REPEAT LOOP1
02211 0773 A7                    AND  A                   ;INPUT$:=(INPUT PORT)
02212 0774 28FC                  JR   Z,OUTP4            ;LOOP1  UNTIL INPUT$<>0
02213 0776 36FF                  LD   (HL),0FFH           ;SEND *** INVERT ZERO ****
02214 0778 FE01                  CP   STROBE              ;IF INPUT$= STROBE$ THEN FINISH
02215 077A 2803                  JR   Z,OUTP5
02216                    ;(*PANIC BUTTON---WE BOTH SENT AT THE SAME TIME,*)
02217 077C F1                    POP  AF
02218 077D 18DD                  JR   OUTP3               ;GO TRY AGAIN TO DO THE OUTPUT.
02219 077F F1            OUTP5   POP  AF
02220 0780 E1                    POP  HL
02221 0781 D1                    POP  DE
02222 0782 C1                    POP  BC
02223 0783 FB            OUTP6   EI
02224 0784 C9                    RET                      ;DONE
02226
```

```
Scalars

ALENB -- 0002      ALLBINS  0005      ALLOWT - 0007      BENTJAM  1000      CMPL --- 0003
COLLF -- 0002      COLOFF - 0005      CONFIG - 0006      COPB --- 0004      CYCEND - 0012
DFLAG -- 0003      DIGF --- 0005      DIGMSK - 000F      DISMISS  000B      DIVC --- 0041
DIVERT - 0006      DNDV --- 0011      DOWN --- 0004      DRIVEM - 0000      DSHOFF - 000A
DVD ---- 0001      DVMC --- 0001      ENDSTACK 1038      ENTJAM - 1000      ENTRY -- 0007
ERRMSK - 001F      ESHOFF - 0006      ESTAT -- 0002      HOME --- 0002      IGATE -- 0009
IGATEDIV 0049      IMIN --- 0500      IN1 ---- 0007      IN2 ---- 0006      IN3 ---- 0005
IN4 ---- 0004      INSGATE  0003      INTF --- 0003      INTLK -- 00F0      INTLOK - 0001
IREADBUF 1000      ISTROBE  00FE      JAM1 --- 0080      JAM2 --- 00E0      JAMCNT - 0250
JAMFLAG  0000      JAMMAN - 0003      JAMSTOP  0007      JBUF --- 0001      JCLEAR - 00B0
JMRST -- 0003      ISTAT -- 0000      MANCNT - 0090      MANHOLD  0250      MANI --- 0090
MANINS - 0003      MANINX - 0006      MANMOD - 0007      MANMSK - 001F      MANTIME  3000
MEMSTART 1000      MODCHG - 0004      MODMSK - 00F8      MPY ---- 0001      N2B ---- 00D0
NBINS -- 0003      NEWJOB - 0006      NUMCOM - 000E      NUMDIG - 0004      NUMERR - 0003
NUMPKTS  0014      ODIS --- 0005      OPTEST - 0000      OVFL --- 00C0      PBIN --- 0001
PINB --- 00A0      PKTSZ -- 0064      PORT1 -- 1801      PORT2 -- 1802      PORT3 -- 1803
PORTC -- 1800      PPD ---- 0002      PRF ---- 0001      PRFC --- 0003      PRFCNT - 0400
PROOFF - 0000      PSDP --- 0000      PWRDN -- 0500      RAMSIZE  0100      RAMSTART 100A
RBIN1 -- 1805      ROLLOVER 0003      SAVE --- 0004      SLSTOP - 0004      SORTF -- 0001
SPALLOW  10C0      SPARE -- 1804      SPCJAM - 10E0      SPIJAM - 1058      SPKTSZ - 0032
SPOPER - 1100      SPPRFTSK 10A0      SPRUNO - 107C      SRDY --- 0010      STACK -- 1100
STARTF - 0006      STARTMSK 0050      STROBE - 0001      THRES -- 0003      TMIN --- 3000
TRANSTIM 3000      TSET --- 001B      TTIME -- 0020      TURNOFF  2000      UP ----- 0005
UPDIV -- 0061      VANE --- 0005      WAIT --- 0010      WAIT10 - 0020      WAIT500  0500

XOSYS (default) Section (1030)

ALLOFF - 0406      ALLOW -- 03A6      ALLOW1 - 03AF      ALLOW2 - 03C9      BCDBIN - 02AF
BUFCNT - 101C      CJAM --- 02D0      CJAM1 -- 02DB      CJAM2 -- 02E5      CJPTAB - 0723
COLL --- 0202      COMTAB - 0711      CONDIG - 027A      CONDIG1  0285      CONFIGU  101C
COPCT -- 1011      COPJAM - 01E2      COPJAM1  01E7      CTASK -- 102C      DIGONE - 102C
DIGTHREE 1024      DIGTWO - 1022      DISM1 -- 0068      EJAM --- 05CE      EJAM0 -- 05CI
EJAM1 -- 05EB      EJAM1A - 05D7      EJAM1B - 05EF      EJAM2 -- 05FB      EJAM3 -- 061C
ENDSEN - 016F      ENTRYJAM 05AD      FIRDIG - 025D      GOHOME - 0555      HOMETSK  054C
HTSK1 -- 055C      HTSK2 -- 0564      HTSK3 -- 0570      HTSK4 -- 0572      IJAM --- 0324
IJAM1 -- 033C      INDEX -- 04F3      INDEX1 - 04FB      INDEX2 - 04FB      INDEX2A  0507
INDEX3 - 050D      INITNT - 0090      INTASK - 00DA      INTCHK - 031B      INTRPT - 0227
INTRPT1  023A      INTRTP - 0038      IYDFLAG  100D      IYDIGF - 100F      IYESTAT  100C
IYJBUF - 100B      IYJSTAT  100A      IYSAVE - 100E      JAMRES - 02EB      JAMRES1  02EC
JAMRES2  02FD      JAMTSK - 034D      JAMTSKO  0365      JAMTSK1  0368      JAMTSK2  0372
JAMTSK3  037F      JAMTSK4  03A3      JOBCNT - 1016      JRESET - 01F2      MANO --- 065E
MANA --- 0636      MANB --- 045D      MANC --- 064C      MANON -- 0652      MANUAL - 062E
MANUAL1  0661      MINO --- 068B      MINDEX - 0676      MINDEX0  068D      MINDEX1  06A3
MINDEX2  06A6      MINDEX3  06B1      MODOFF - 017E      MODOFF1  018B      MODOFF2  0181
NOSWITCH 00B8      NUMBUF - 101E      OPER --- 014B      OPER1 -- 014C      OPER2 -- 0153
OUTP3 -- 075C      OUTP4 -- 0772      OUTP5 -- 077F      OUTP6 -- 0783      OUTPUT - 074F
P1MOD -- 0179      PAPER -- 04A6      PAPER0 - 04B4      PAPER1 - 04BF      PAPER1A  04C4
PAPER3 - 04CB      PAPER3A  04D5      PAPER4 - 04DA      PAPER5 - 04E4      PRFRUN - 059C
PRFTSK - 057C      PRFTSK0  0579      PRFTSK1  0580      PRIOUT - 0758      PROOF -- 01FI
PTASK -- 102E      READ --- 06C1      READ0 -- 06C0      READ2 -- 06C4      READ3 -- 06C4
READ4 -- 06E6      READ4A - 06EB      READ5 -- 06F9      READ5A - 06FF      READ6 -- 0707
READBUF  102B      RESBIN - 0512      RESET -- 00FB      RESTART  0000      RLTBUF - 1014
RUN ---- 044D      RUN1 --- 0416      RUN2 --- 0421      RUN3 --- 0425      RUN4 --- 0433
RUN6A -- 0445      RUN6B -- 043A      RUN7 --- 0450      RUN7A -- 0476      RUN8 --- 048D
RUN9 --- 049C      SBUFCNT  101A      SECDIG - 0253      SENSOR - 03DE      SENSOR1  03ED
SENSOR2  03F9      SETHOME  053E      SETMOD - 020B      SHEETCNT 1013      SJOBCNT  1018
SLID10 - 0537      SLID8 -- 0529      SLID9 -- 052F      SLIDEX - 0521      SLOWDOWN 03FF
SORT --- 0206      SORTRDY  0745      START -- 01A1      START0 - 0190      START1 - 01AE
START2 - 01B4      START3 - 01C4      START4 - 01CB      START5 - 01D3      STOP --- 01F3
SWITCH - 006E      SWX ---- 0074      TEST --- 029D      TEST1 -- 029F      TEST2 -- 02A6
THDIG -- 0258      TIMER -- 102A      TIMES10  02C5      TRANSCNT 1012      TRMCT -- 00C3
TRNON1 - 039C      TSTMAN - 0670      TTIM1 -- 0025      TTIM2 -- 002C      TURNON - 038A
TURNONO  03B6      UNFREZE  0302      UNFREZE0 030F      UNFREZE1 0313      WAIT1 -- 0011
WRITEBUF 1026      WRMSTART 010E

2226 Source Lines    2226 Assembled Lines    9041 Bytes available

>>> No assembly errors detected <<<
```

What is claimed is:

1. A sophisticated collator capable of intercommunicating with a computer of a computer-controlled photocopier to receive job commands from the photocopier regarding the mode and size of a collating job to be transmitted to the collator directly from the photocopier, to store the job commands in a buffer, and to control the collating operations of the collator based upon the job commands while reporting progress of the collating operations to the photocopier during the operation, comprising:

(a) a sheet conveyor system for receiving sheets from the photocopier and for transporting the sheets to trays in a bin unit during the collating operation, the system including a movable deflector means for deflecting the sheets from a conveyor into predetermined trays;

(b) a logic control means, having a programmable computer with a stored program, for communicating with the computer of the photocopier and for controlling the collating operations in the collator upon receipt of the job commands from the photocopier, including a buffer for storing the job commands to remove dependency upon the photocopier for continued checking of the desired collating operation, the logic control means being connected to means for sensing collating operation information within the collator to monitor the collating operation and being connected to the conveyor system to control operation of the conveyor system;

(c) means for sensing the entry of a sheet into the collator from the photocopier and for signalling the entry to the logic control means so that the logic control means can count the entry of the sheet and monitor the passage of the sheet along the conveyor system to a predetermined tray selected on the basis of the job commands;

(d) means for identifying the individual trays of the bin unit by counting the operation of the deflector means at each tray so that the position of the deflector means ready to deflect sheets to a tray represents the position of the tray; and (e) means for sensing entry of the sheet into the predetermined tray and for signalling the entry to the logic control means so that the logic control means can count the entry and command continued collating operations based upon the entry, such as changing the deflector means or signalling a jam to the photocopier.

2. The collator of claim 1 wherein the conveyor system includes a laterally spaced, double vacuum belt system to better control wide paper.

3. The collator of claim 1, further comprising manual insertion means connected with the conveyor system for receiving sheets from a source other than the photocopier, for signalling the receipt to the logic control means, and for conveying the sheets to the conveying system upon the command of the logic control means, wherein the manual insertion means may be used to collate sheets in the collator independently of job commands generated in the photocopier.

4. The collator of claim 1, further comprising means for detecting whether there are any sheets in any tray of a bin unit and for signalling whether there are any sheets in any tray to the logic control unit so that the logic control unit can determine whether the job command is able to be completed.

5. The collator of claim 1, further comprising means for attaching additional bin units to the collator, and means for detecting attachment of additional bin units and for signalling the attachment to the logic control means so that the logic control unit can control the additional bin units when controlling the collator operations.

6. The collator of claim 5, further comprising diverter fingers in each bin unit, controlled by the logic control means, for diverting sheets on command from the logic control means over a bin unit and into an adjacent bin unit.

7. The collator of claim 1, further comprising a proof tray for receiving sheets in one mode of operation and means for proofing, controlled by the logic control means, for diverting a sheet from the conveyor system to the proof tray upon command from the logic control means.

8. A sophisticated collator capable of intercommunicating with a computer of a computer-controlled photocopier to receive job commands from the photocopier regarding the mode and size of a collating job to be transmitted to the collator directly from the photocopier, to store the job commands in a buffer, and to control the collating operations of the collator based upon the job commands while reporting progress of the collating operations to the photocopier during the operation, comprising:

(a) a sheet conveyor system for receiving sheets from the photocopier and for transporting the sheets to trays in a bin unit during the collating operation, the system including a deflector means for deflecting the sheets from a conveyor into predetermined trays;

(b) a logic control means having a programmable computer with a stored program for communicating with the computer of the photocopier and for controlling the collating operation in the collator upon receipt of the job commands from the photocopier, including a buffer for storing the job commands to remove dependency upon the photocopier for continued checking of the desired collating operation, the logic control means being connected to means for sensing within the collator to monitor the collating operation and being connected to the conveyor system to control operation of the conveyor system (c) means for sensing the entry of a sheet into the collator from the photocopier and for signalling the entry to the logic control means so that the logic control means can count the entry of the sheet and monitor the passage of the sheet along the conveyor system to a predetermined tray selected on the basis of the job commands;

(d) means for identifying the individual trays of the bin unit by counting the operation of the deflector means at each tray so that the position of the deflector means ready to deflect sheets to a tray represents the position of the tray;

(e) means for sensing entry of the sheet into the predetermined tray and for signalling the entry to the logic control means so that the logic control means can count the entry and command continued collating operations based upon the entry, such as moving the deflector or signalling a jam to the photocopier;

(f) manual insertion means connected with the conveyor system for receiving sheets from a source other than the photocopier, for signalling the receipt to the logic control means, and for conveying the sheets to the conveying system upon a command from the logic control means, wherein the manual insertion means may be used to collate sheets in the collator independently of job commands generated in the photocopier;

(g) means for attaching additional bin units to the collator;

(h) means for detecting attachment of additional bin units and for signalling the attachment to the logic control means so that the logic control means can control the additional bin units when controlling the collator operations;

(i) proof tray for receiving sheets in one mode of operation and means for proofing, controlled by the logic control means, for diverting a sheet from the conveyor system to the proof tray upon command from the logic control means; (j) means for diverting sheets from one bin unit into an adjacent bin unit.

* * * * *